US010950917B2

(12) United States Patent
Ashida et al.

(10) Patent No.: US 10,950,917 B2
(45) Date of Patent: Mar. 16, 2021

(54) DIELECTRIC RESONATOR AND DIELECTRIC FILTER

(71) Applicant: TDK CORPORATION, Tokyo (JP)

(72) Inventors: Yuta Ashida, Tokyo (JP); Noriyuki Hirabayashi, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 85 days.

(21) Appl. No.: 16/351,609

(22) Filed: Mar. 13, 2019

(65) Prior Publication Data

US 2019/0326654 A1 Oct. 24, 2019

(30) Foreign Application Priority Data

Apr. 24, 2018 (JP) ..... JP2018-083118

(51) Int. Cl.

| | |
|---|---|
| ***H01P 1/20*** | (2006.01) |
| ***H01P 7/10*** | (2006.01) |
| ***H01P 1/208*** | (2006.01) |
| ***H01P 1/18*** | (2006.01) |

(52) U.S. Cl.

CPC ..... *H01P 1/2002* (2013.01); *H01P 1/18* (2013.01); *H01P 1/2088* (2013.01); *H01P 7/10* (2013.01)

(58) Field of Classification Search

CPC ..... H01P 1/2084; H01P 1/2088; H01P 1/213; H01P 1/30; H01P 7/10

USPC ..... 333/208–212

See application file for complete search history.

(56) References Cited

U.S. PATENT DOCUMENTS

2003/0155865 A1* 8/2003 Ito ..... H01P 1/2088 315/100
2004/0041663 A1* 3/2004 Uchimura ..... H01P 1/2088 333/135
2005/0035832 A1* 2/2005 Salmela ..... H01P 3/06 333/222
2017/0077573 A1* 3/2017 Yuan ..... H01P 1/201

FOREIGN PATENT DOCUMENTS

JP 2006-238027 A 9/2006

* cited by examiner

*Primary Examiner* — Rakesh B Patel
(74) *Attorney, Agent, or Firm* — Oliff PLC

(57) ABSTRACT

A dielectric filter includes a plurality of dielectric resonators. The dielectric filter further includes a plurality of resonator bodies corresponding to the plurality of dielectric resonators, and a peripheral dielectric portion lying around the plurality of resonator bodies. Each of the plurality of resonator bodies is formed of a first dielectric having a first relative permittivity. The peripheral dielectric portion is formed of a second dielectric having a second relative permittivity lower than the first relative permittivity. Each of the plurality of resonator bodies includes a plurality of individual elements separated from each other.

18 Claims, 21 Drawing Sheets

DIELECTRIC RESONATOR AND DIELECTRIC FILTER

BACKGROUND OF THE INVENTION

1. Field of the Invention

The present invention relates to a dielectric resonator, and a dielectric filter including a plurality of dielectric resonators.

2. Description of the Related Art

The standardization of fifth-generation mobile communication systems (hereinafter referred to as 5G) is currently ongoing. For 5G, the use of frequency bands of 10 GHz or higher, particularly a quasi-millimeter wave band of 10 to 30 GHz and a millimeter wave band of 30 to 300 GHz, is being studied to expand the frequency band.

Among electronic components for use in communication apparatuses are band-pass filters each including a plurality of resonators. Dielectric filters each including a plurality of dielectric resonators are promising as band-pass filters usable in the frequency bands of 10 GHz or higher.

A dielectric resonator typically includes a resonator body formed of a dielectric, and a peripheral dielectric portion lying around the resonator body. The peripheral dielectric portion is formed of a dielectric having a relative permittivity lower than that of the dielectric forming the resonator body.

JP2006-238027A describes a dielectric filter that includes a dielectric substrate and a plurality of dielectric resonators embedded in the dielectric substrate. JP2006-238027A further describes a method of forming the dielectric substrate and the plurality of dielectric resonators by preparing a plurality of composite sheets, stacking the plurality of composite sheets to form a laminate structure, and firing the laminate structure. The plurality of composite sheets are each formed by embedding a plurality of high permittivity dielectric sheets in a plurality of notches formed in a low permittivity dielectric sheet. Each of the plurality of dielectric resonators described in JP2006-238027A corresponds to the resonator body mentioned above. The dielectric substrate described in JP2006-238027A corresponds to the peripheral dielectric portion mentioned above.

The resonator body of the conventional dielectric resonator is formed by, for example, firing a molded structure of unfired ceramic. The firing causes shrinkage of the structure. In the conventional dielectric resonator, the volume of the resonator body varies relatively greatly due to, for example, the formation method for the resonator body such as the above-described method. A change in the volume of the resonator body in the dielectric resonator causes a change in the resonant frequency. The conventional dielectric resonator thus has a problem of a relatively large variation in the resonant frequency due to a variation in the volume of the resonator body.

SUMMARY OF THE INVENTION

It is an object of the present invention to provide a dielectric resonator and a dielectric filter capable of reducing a variation in the resonant frequency resulting from a variation in the volume of the resonator body.

A dielectric resonator of the present invention includes a resonator body, and a peripheral dielectric portion lying around the resonator body. The resonator body is formed of a first dielectric having a first relative permittivity. The peripheral dielectric portion is formed of a second dielectric having a second relative permittivity lower than the first relative permittivity. The resonator body includes a plurality of individual elements separated from each other.

In the dielectric resonator of the present invention, a distance between adjacent two of the plurality of individual elements may be less than or equal to a quarter of a wavelength corresponding to the resonant frequency of the dielectric resonator inside the peripheral dielectric portion.

The resonance mode of the dielectric resonator of the present invention may be a TM mode.

In the dielectric resonator of the present invention, all the plurality of individual elements may have a rotationally symmetrical shape with respect to an axis in the same direction.

In the dielectric resonator of the present invention, all the plurality of individual elements may have a rod-like shape long in a first direction. In such a case, adjacent two of the plurality of individual elements are adjacent to each other in a direction orthogonal to the first direction. In such a case, the first direction may be the direction of propagation of electromagnetic waves in the dielectric resonator.

In the dielectric resonator of the present invention, the plurality of individual elements may be aligned in a first direction. In such a case, the first direction may be the direction of propagation of electromagnetic waves in the dielectric resonator.

In the dielectric resonator of the present invention, the resonator body may include a plurality of individual element groups aligned in a first direction. Each of the plurality of individual element groups includes a plurality of individual elements. In each of the plurality of individual element groups, adjacent two of the plurality of individual elements are adjacent to each other in a direction orthogonal to the first direction. In such a case, the first direction may be the direction of propagation of electromagnetic waves in the dielectric resonator. Two of the plurality of individual element groups adjacent in the first direction may be offset with respect to each other as viewed in a direction parallel to the first direction.

The dielectric resonator of the present invention may further include a shield portion formed of a conductor. The shield portion lies around the resonator body such that at least part of the peripheral dielectric portion is interposed between the shield portion and the resonator body.

In the dielectric resonator of the present invention, the peripheral dielectric portion may include a multilayer stack composed of a plurality of dielectric layers stacked together. In such a case, the dielectric resonator may further include a shield portion formed of a conductor. The shield portion lies around the resonator body such that at least part of the peripheral dielectric portion is interposed between the shield portion and the resonator body. The shield portion may include a first conductor layer and a second conductor layer lying at different positions in a direction in which the plurality of dielectric layers are stacked, and a plurality of through hole lines connecting the first and second conductor layers. Each of the plurality of through hole lines includes two or more through holes connected in series.

A dielectric filter of the present invention includes a plurality of dielectric resonators, a plurality of resonator bodies respectively corresponding to the plurality of dielectric resonators, and a peripheral dielectric portion lying around the plurality of resonator bodies. The plurality of resonator bodies are each formed of a first dielectric having a first relative permittivity. The peripheral dielectric portion is formed of a second dielectric having a second relative permittivity lower than the first relative permittivity. Each of the plurality of resonator bodies includes a plurality of individual elements separated from each other.

In the dielectric filter of the present invention, a distance between adjacent two of the plurality of individual elements in each of the plurality of resonator bodies may be smaller than a distance between adjacent two of the plurality of the resonator bodies.

In the dielectric filter of the present invention, a distance between adjacent two of the plurality of individual elements in each of the plurality of resonator bodies may be less than or equal to a quarter of a wavelength corresponding to the resonant frequency of a corresponding one of the plurality of dielectric resonators inside the peripheral dielectric portion.

In the dielectric filter of the present invention, the resonance mode of each of the plurality of dielectric resonators may be a TM mode.

The dielectric filter of the present invention may further include a shield portion formed of a conductor. The shield portion lies around the plurality of resonator bodies such that at least part of the peripheral dielectric portion is interposed between the shield portion and the plurality of resonator bodies. Each of the plurality of dielectric resonators may be composed of a corresponding one of the plurality of resonator bodies, at least part of the peripheral dielectric portion, and the shield portion.

According to the dielectric resonator and the dielectric filter of the present invention, it is possible to reduce a variation in the resonant frequency of the dielectric resonator resulting from a variation in the volume of the resonator body.

Other and further objects, features and advantages of the invention will appear more fully from the following description.

DETAILED DESCRIPTION OF THE PREFERRED EMBODIMENTS

First Embodiment

Figure 1:
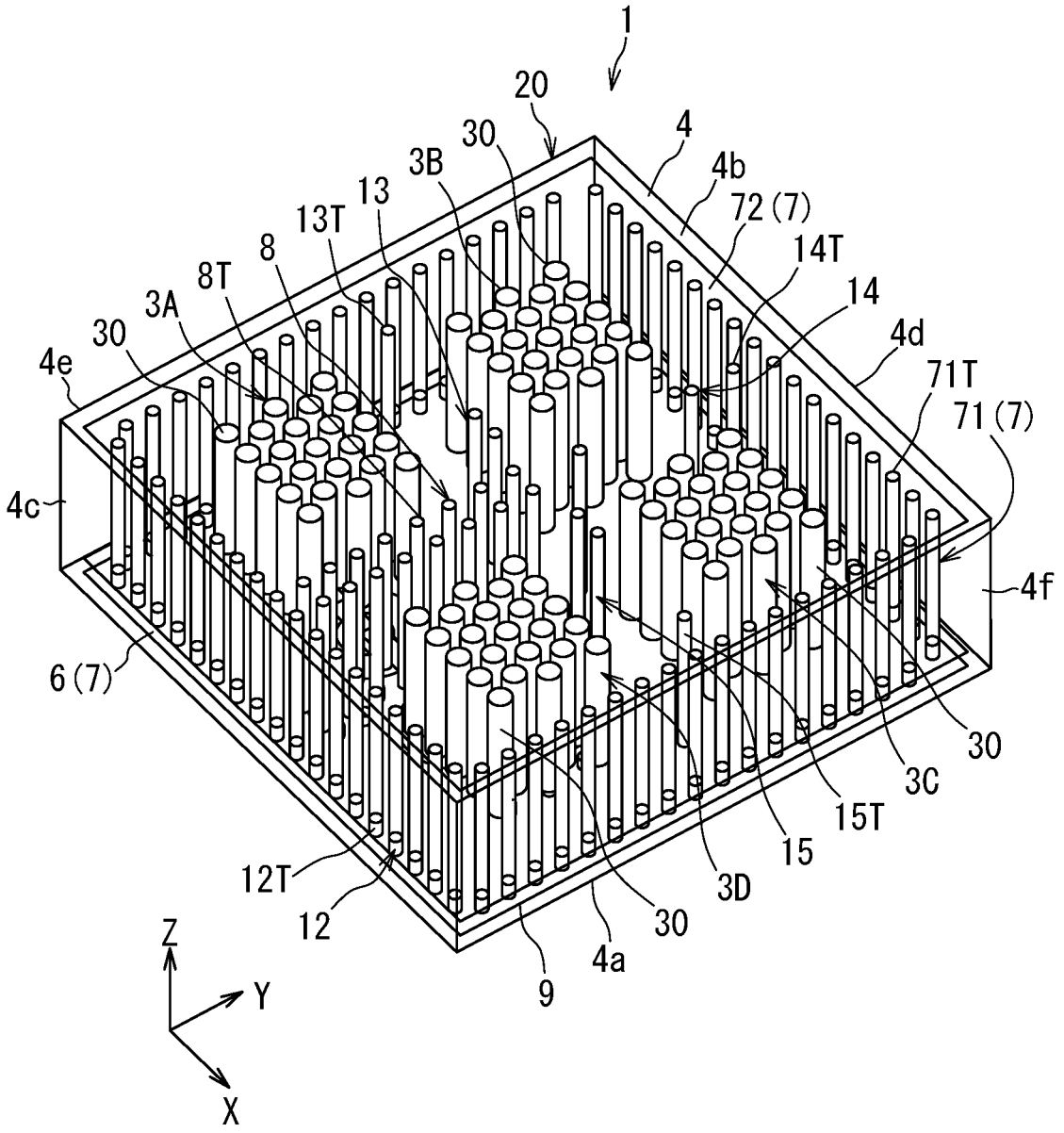
FIG. 1 is a perspective view illustrating the interior of a dielectric filter according to a first embodiment of the invention.
Figure 2:
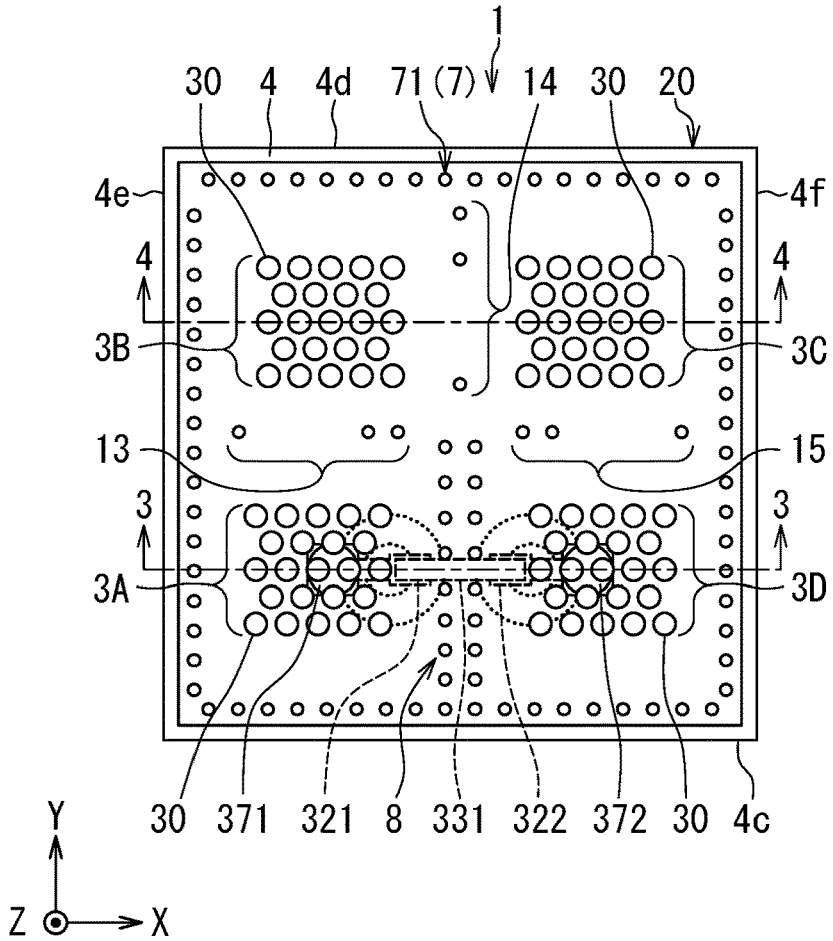
FIG. 2 is a plan view illustrating the interior of the dielectric filter according to the first embodiment of the invention.
Figure 3:
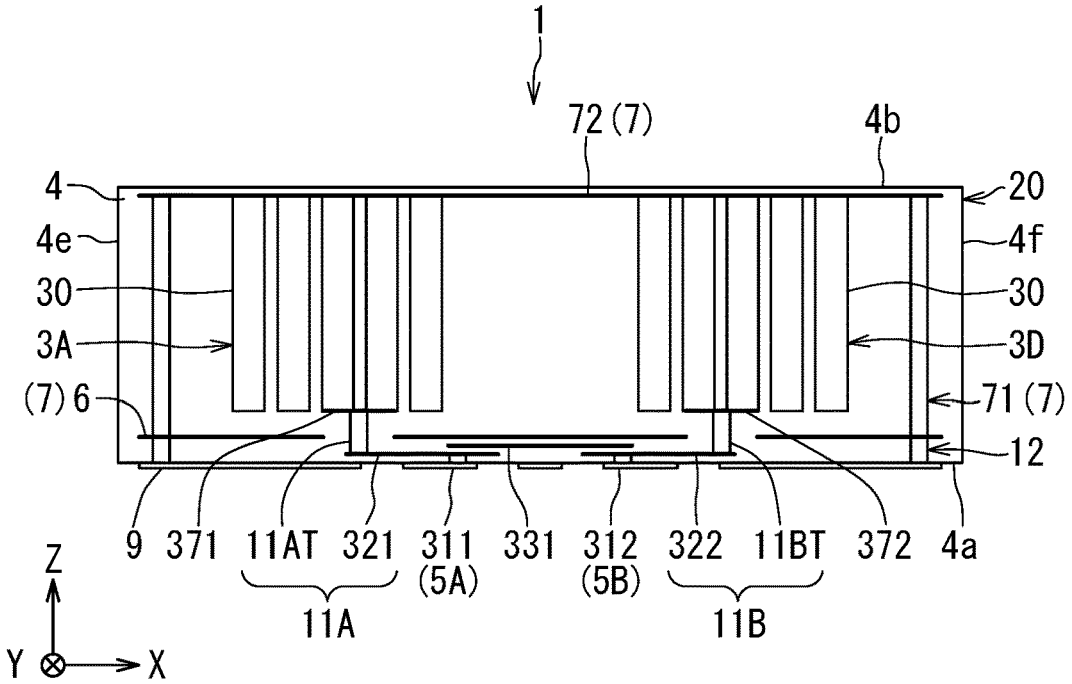
FIG. 3 is a cross-sectional view illustrating a cross section of the dielectric filter taken along line 3-3 of FIG. 2.
Figure 4:
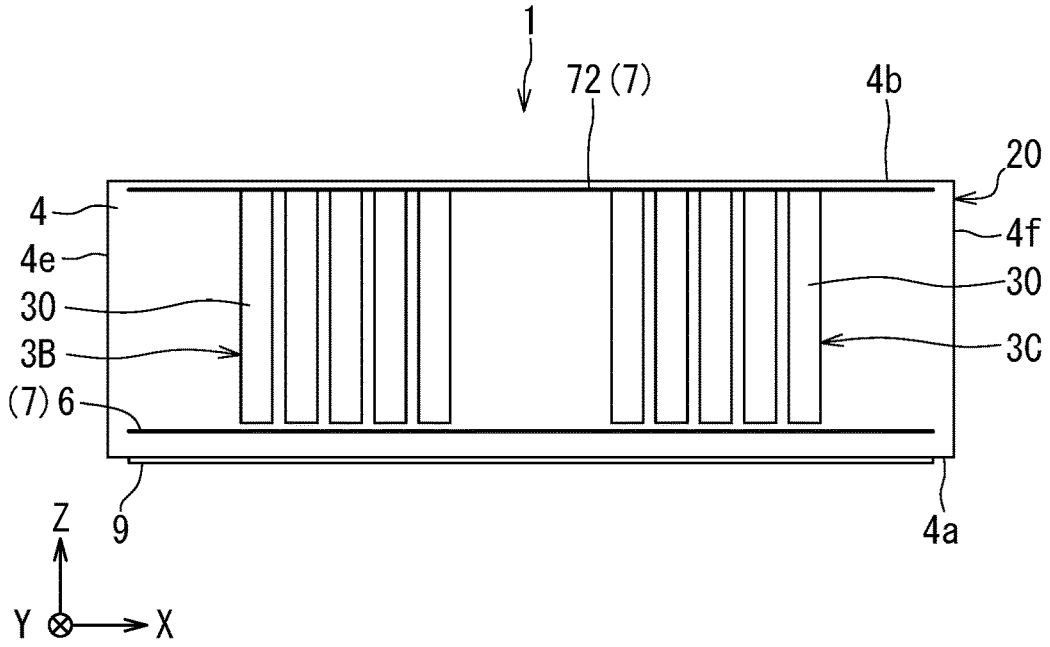
FIG. 4 is a cross-sectional view illustrating a cross section of the dielectric filter taken along line 4-4 of FIG. 2.
Figure 5:
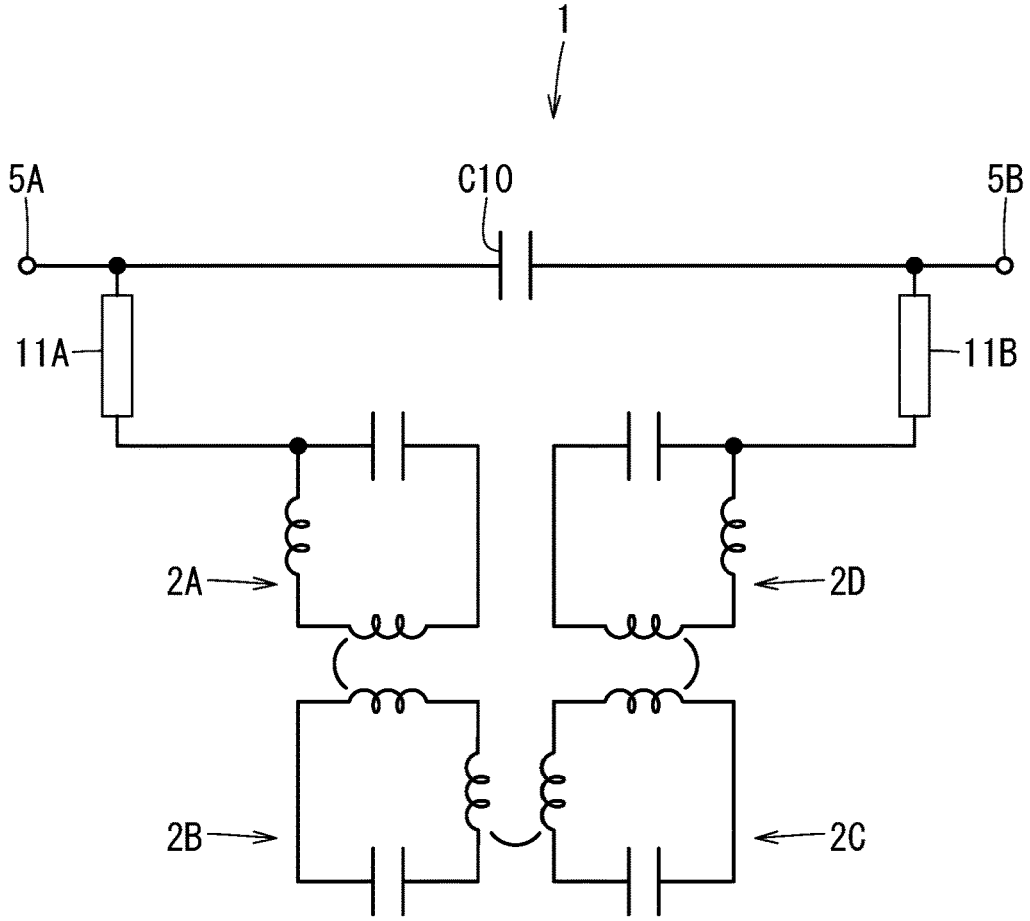
FIG. 5 is a circuit diagram illustrating an equivalent circuit of the dielectric filter according to the first embodiment of the invention.

Preferred embodiments of the present invention will now be described in detail with reference to the drawings. First, reference is made to FIG. 1 to FIG. 5 to describe the configuration of a dielectric filter according to a first embodiment of the invention. FIG. 1 is a perspective view illustrating the interior of the dielectric filter according to the first embodiment. FIG. 2 is a plan view illustrating the interior of the dielectric filter according to the first embodiment. FIG. 3 is a cross-sectional view illustrating a cross section of the dielectric filter taken along line 3-3 of FIG. 2. FIG. 4 is a cross-sectional view illustrating a cross section of the dielectric filter taken along line 4-4 of FIG. 2. FIG. 5 is a circuit diagram illustrating an equivalent circuit of the dielectric filter according to the first embodiment.

The dielectric filter 1 according to the present embodiment has a band-pass filter function. As shown in FIG. 5, the dielectric filter 1 includes a first input/output port 5A, a second input/output port 5B, a plurality of dielectric resonators, and a capacitor C10 for capacitively coupling the first input/output port 5A and the second input/output port 5B. Each of the plurality of dielectric resonators is a dielectric resonator according to the present embodiment.

The capacitor C10 is provided between the first input/output port 5A and the second input/output port 5B, and has a first end connected to the first input/output port 5A and a second end connected to the second input/output port 5B.

The plurality of dielectric resonators are provided between the first input/output port 5A and the second input/output port 5B in circuit configuration, and are configured so that two dielectric resonators adjacent to each other in circuit configuration are magnetically coupled to each other. As used herein, the phrase "in circuit configuration" is to describe layout in a circuit diagram, not in a physical configuration.

The present embodiment presents an example in which the dielectric filter 1 includes four dielectric resonators 2A, 2B, 2C, and 2D, as shown in FIG. 5. The dielectric resonators 2A, 2B, 2C, and 2D are arranged in this order, from closest to farthest, from the first input/output port 5A in circuit configuration. The dielectric resonators 2A, 2B, 2C, and 2D are configured so that: the dielectric resonators 2A and 2B are adjacent to each other in circuit configuration and are magnetically coupled to each other; the dielectric resonators 2B and 2C are adjacent to each other in circuit configuration and are magnetically coupled to each other; and the dielectric resonators 2C and 2D are adjacent to each other in circuit configuration and are magnetically coupled to each other. Each of the dielectric resonators 2A, 2B, 2C, and 2D has an inductance and a capacitance.

Hereinafter, the dielectric resonator 2A which is closest to the first input/output port 5A in circuit configuration will also be referred to as the first input/output stage resonator 2A, and the dielectric resonator 2D which is closest to the second input/output port 5B in circuit configuration will also be referred to as the second input/output stage resonator 2D. The dielectric resonator 2B will also be referred to as the first intermediate resonator 2B. The dielectric resonator 2C will also be referred to as the second intermediate resonator 2C.

As shown in FIG. 5, the dielectric filter 1 further includes a first phase shifter 11A and a second phase shifter 11B. Each of the first and second phase shifters 11A and 11B causes a change in the phase of a signal passing therethrough. The amount of the change in the phase caused by each of the first and second phase shifters 11A and 11B will hereinafter be referred to as a phase change amount.

The first phase shifter 11A is provided between the first input/output port 5A and the first input/output stage resonator 2A in circuit configuration. The second phase shifter 11B is provided between the second input/output port 5B and the second input/output stage resonator 2D in circuit configuration.

As shown in FIG. 1 to FIG. 4, the dielectric filter 1 includes a structure 20 for constructing the first and second input/output ports 5A and 5B, the dielectric resonators 2A, 2B, 2C and 2D, the capacitor C10, and the first and second phase shifters 11A and 11B.

The structure 20 includes a plurality of resonator bodies respectively corresponding to the plurality of dielectric resonators, and a peripheral dielectric portion 4 lying around the plurality of resonator bodies. Each of the plurality of resonator bodies is formed of a first dielectric having a first relative permittivity. The peripheral dielectric portion 4 is formed of a second dielectric having a second relative permittivity lower than the first relative permittivity. An example of the first and second dielectrics is ceramic. In the present embodiment, specifically, the structure 20 includes four resonator bodies 3A, 3B, 3C, and 3D corresponding to the four dielectric resonators 2A, 2B, 2C, and 2D, respectively.

Hereinafter, the resonator body 3A corresponding to the first input/output stage resonator 2A will also be referred to as the first input/output stage resonator body 3A, and the resonator body 3D corresponding to the second input/output stage resonator 2D will also be referred to as the second input/output stage resonator body 3D. The resonator body 3B corresponding to the first intermediate resonator 2B will also be referred to as the first intermediate resonator body 3B. The resonator body 3C corresponding to the second intermediate resonator 2C will also be referred to as the second intermediate resonator body 3C.

In the present embodiment, the peripheral dielectric portion 4 includes a multilayer stack composed of a plurality of dielectric layers stacked together. Now, we define X, Y and Z directions as shown in FIG. 1 to FIG. 4. As shown, the X, Y and Z directions are orthogonal to each other. In the present embodiment, the plurality of dielectric layers are stacked in the Z direction (the upward direction in FIG. 1). The Z direction corresponds to the first direction in the present invention. As used herein, the term "above" refers to positions located forward of a reference position in the Z direction.

The peripheral dielectric portion 4 is in the shape of a rectangular solid and has an external surface. The external surface of the peripheral dielectric portion 4 includes a top surface 4*b* and a bottom surface 4*a* opposite to each other in the Z direction, and four side surfaces 4*c*, 4*d*, 4*e* and 4*f* connecting the top surface 4*b* and the bottom surface 4*a*. The side surfaces 4*c* and 4*d* are opposite to each other in the Y direction. The side surfaces 4*e* and 4*f* are opposite to each other in the X direction.

In the present embodiment, each of the resonator bodies 3A to 3D includes a plurality of individual elements 30 separated from each other. All the plurality of individual elements 30 may have a rotationally symmetrical shape with respect to an axis in the same direction, e.g., the Z direction.

In the present embodiment, specifically, all the plurality of individual elements 30 have a rod-like shape long in the first direction, i.e., the Z direction. Adjacent two of the plurality of individual elements 30 are adjacent to each other in a direction orthogonal to the Z direction. The first direction, i.e., the Z direction, is the direction of propagation of electromagnetic waves in each of the dielectric resonators 2A to 2D.

The plurality of individual elements 30 may each have a rod-like shape rotationally symmetrical with respect to an axis in the Z direction. Examples of such a shape include a cylindrical shape and a regular polygonal columnar shape. FIG. 1 shows an example where the plurality of individual elements 30 each have a cylindrical shape.

In each of the resonator bodies 3A to 3D, the distance between adjacent two of the plurality of individual elements 30 may be less than or equal to a quarter of a wavelength corresponding to the resonant frequency of a corresponding one of the dielectric resonators 2A to 2D inside the peripheral dielectric portion 4.

A coupling factor of the coupling between adjacent two of the plurality of individual elements 30 may be 0.5 or more, or 0.8 or more.

The distance between adjacent two of the plurality of individual elements 30 refers to the minimum distance between the respective external surfaces of the two adjacent individual elements 30, not the distance between the centers of the two adjacent individual elements 30 in a cross section perpendicular to the Z direction.

In each of the resonator bodies 3A to 3D, the distance between adjacent two of the plurality of individual elements 30 may be less than or equal to the maximum diameter of one individual element 30 in a cross section perpendicular to the Z direction.

Each of the resonator bodies 3A to 3D preferably includes three or more individual elements 30. The three or more individual elements 30 of each of the resonator bodies 3A to 3D are preferably aligned in two or more directions orthogonal to the Z direction.

In the example shown in FIGS. 1 and 2, each of the resonator bodies 3A to 3D includes twenty-three individual elements 30. The twenty-three individual elements 30 are aligned in three directions orthogonal to the Z direction. The three directions are, as viewed from above, the X direction, a direction rotated 60° clockwise from the X direction, and a direction rotated 60° counterclockwise from the X direction.

In a cross section perpendicular to the Z direction, the centers of adjacent three of the individual elements 30 may be positioned such that they form a regular triangle when connected by lines.

The resonator bodies 3A to 3D are configured so that the resonator bodies 3A and 3B are adjacent to each other and magnetically coupled to each other, the resonator bodies 3B and 3C are adjacent to each other and magnetically coupled to each other, and the resonator bodies 3C and 3D are adjacent to each other and magnetically coupled to each other.

The distance between adjacent two of the plurality of individual elements 30 in each of the resonator bodies 3A to 3D is smaller than the distance between adjacent two of the resonator bodies 3A to 3D. This means that the coupling factor between two adjacent individual elements 30 is higher than that between two adjacent resonator bodies.

As shown in FIG. 1, the structure 20 further includes a separation conductor layer 6 and a shield portion 7 each formed of a conductor.

The separation conductor layer 6 separates an area where the resonator bodies 3A to 3D lie from an area where the capacitor C10 lies.

The shield portion 7 lies around the resonator bodies 3A to 3D such that at least part of the peripheral dielectric portion 4 is interposed between the shield portion 7 and the resonator bodies 3A to 3D.

In the present embodiment, the separation conductor layer 6 also serves as part of the shield portion 7. The shield portion 7 includes the separation conductor layer 6, a shield conductor layer 72, and a connection portion 71. The separation conductor layer 6 corresponds to the first conductor layer in the present invention. The shield conductor layer 72 corresponds to the second conductor layer in the present invention. FIG. 2 omits the illustration of the shield conductor layer 72.

The separation conductor layer 6 and the shield conductor layer 72 are spaced apart from each other in the Z direction inside the peripheral dielectric portion 4. The separation conductor layer 6 lies near the bottom surface 4*a* of the peripheral dielectric portion 4. The shield conductor layer 72 lies near the top surface 4*b* of the peripheral dielectric portion 4. The resonator bodies 3A to 3D lie in the area between the separation conductor layer 6 and the shield conductor layer 72 within the structure 20. Each of the individual elements 30 has a top end face closest to the shield conductor layer 72 and a bottom end face closest to the separation conductor layer 6.

The connection portion 71 electrically connects the separation conductor layer 6 and the shield conductor layer 72. The connection portion 71 includes a plurality of through hole lines 71T. Each of the plurality of through hole lines 71T includes two or more through holes connected in series. The separation conductor layer 6, the shield conductor layer 72 and the connection portion 71 are arranged to surround the resonator bodies 3A to 3D.

As shown in FIGS. 1 and 2, the first input/output stage resonator body 3A and the second input/output stage resonator body 3D are physically adjacent to each other with neither of the first and second intermediate resonator bodies 3B and 3C interposed therebetween. The resonator bodies 3A and 3D are aligned in the X direction near the side surface 4*c* of the peripheral dielectric portion 4. The resonator bodies 3B and 3C are aligned in the X direction near the side surface 4*d* of the peripheral dielectric portion 4.

As shown in FIG. 1, the structure 20 further includes a partition 8, a ground layer 9, and a connection portion 12 each formed of a conductor.

The partition 8 is intended to prevent the occurrence of magnetic coupling between the first input/output stage resonator body 3A and the second input/output stage resonator body 3D. The partition 8 is arranged to pass between the first input/output stage resonator body 3A and the second input/ output stage resonator body 3D. The partition 8 electrically connects the separation conductor layer 6 and the shield conductor layer 72. The partition 8 includes a plurality of through hole lines 8T. Each of the plurality of through hole lines 8T includes two or more through holes connected in series.

The ground layer 9 is disposed on the bottom surface 4*a* of the peripheral dielectric portion 4. The connection portion 12 electrically connects the ground layer 9 and the separation conductor layer 6. The connection portion 12 includes a plurality of through hole lines 12T. Each of the plurality of through hole lines 12T includes two or more through holes connected in series.

The ground layer 9, the separation conductor layer 6 and the shield conductor layer 72 are all rectangular in shape as viewed in a direction parallel to the Z direction.

As shown in FIG. 1, the structure 20 further includes coupling adjustment portions 13, 14 and 15 each formed of a conductor.

The coupling adjustment portion 13 is intended to adjust the magnitude of the magnetic coupling between the resonator bodies 3A and 3B. The coupling adjustment portion 14 is intended to adjust the magnitude of the magnetic coupling between the resonator bodies 3B and 3C. The coupling adjustment portion 15 is intended to adjust the magnitude of the magnetic coupling between the resonator bodies 3C and 3D. Each of the coupling adjustment portions 13, 14 and 15 electrically connects the separation conductor layer 6 and the shield conductor layer 72.

In the example shown in FIG. 1, the coupling adjustment portion 13 includes three through hole lines 13T. The coupling adjustment portion 14 includes three through hole lines 14T. The coupling adjustment portion 15 includes three through hole lines 15T. Each of the through hole lines 13T, 14T and 15T includes two or more through holes connected in series.

The dielectric resonator 2A is composed of the resonator body 3A, at least part of the peripheral dielectric portion 4, and the shield portion 7. The dielectric resonator 2B is composed of the resonator body 3B, at least part of the peripheral dielectric portion 4, and the shield portion 7. The dielectric resonator 2C is composed of the resonator body 3C, at least part of the peripheral dielectric portion 4, and the shield portion 7. The dielectric resonator 2D is composed of the resonator body 3D, at least part of the peripheral dielectric portion 4, and the shield portion 7.

In the present embodiment, the resonance mode of each of the dielectric resonators 2A to 2D is a TM mode. An electromagnetic field generated by the dielectric resonators 2A to 2D is present inside and outside the resonator bodies 3A to 3D. The shield portion 7 has a function of confining the electromagnetic field present outside the resonator bodies 3A to 3D to within the area surrounded by the shield portion 7.

Reference is now made to FIGS. 6 to 13 to describe an example of the plurality of dielectric layers constituting the peripheral dielectric portion 4 and an example of the configurations of a plurality of conductor layers formed on the dielectric layers and a plurality of through holes formed in the dielectric layers. In this example, the peripheral dielectric portion 4 includes thirty-two dielectric layers stacked together. The thirty-two dielectric layers will hereinafter be referred to as the first to thirty-second dielectric layers, respectively, in the order from bottom to top. The first to thirty-second dielectric layers will be denoted by the reference numerals 31 to 62, respectively. In FIGS. 6 to 12, each small circle represents a through hole.

Figure 6:
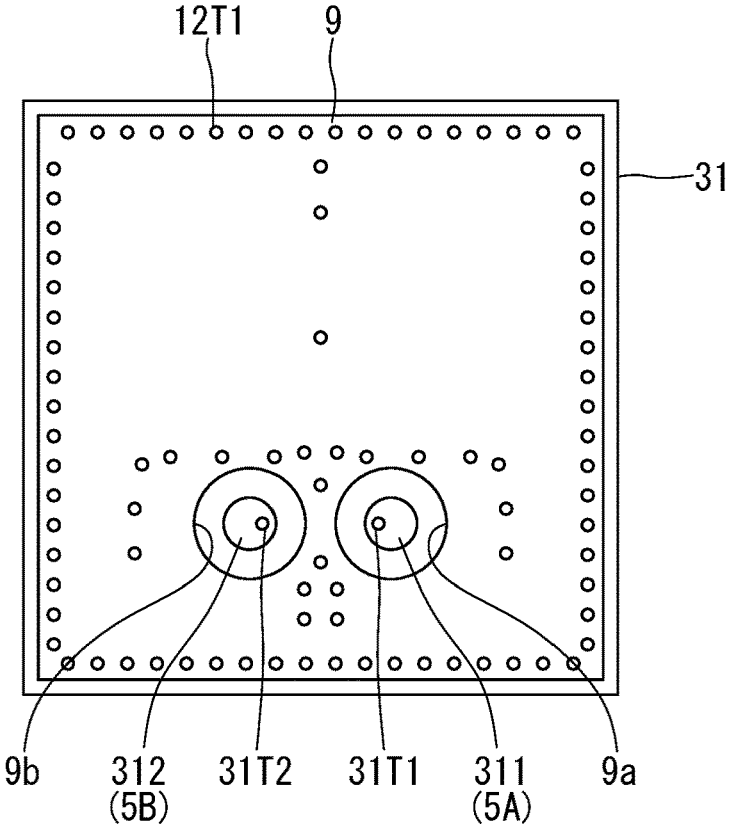
FIG. 6 is a plan view illustrating a patterned surface of a first dielectric layer of a peripheral dielectric portion shown in FIG. 1.

FIG. 6 illustrates a patterned surface of the first dielectric layer 31. On the patterned surface of the dielectric layer 31, there are formed the ground layer 9, a conductor layer 311 forming the first input/output port 5A, and a conductor layer 312 forming the second input/output port 5B. Two circular holes 9*a* and 9*b* are formed in the ground layer 9. The conductor layer 311 lies inside the hole 9*a*, and the conductor layer 312 lies inside the hole 9*b*.

Further, a through hole 31T1 connected to the conductor layer 311, and a through hole 31T2 connected to the conductor layer 312 are formed in the dielectric layer 31. Further formed in the dielectric layer 31 are a plurality of through holes 12T1 constituting respective portions of the plurality of through hole lines 12T. All the through holes in FIG. 6 except the through holes 31T1 and 31T2 are the through holes 12T1. The through holes 12T1 are connected to the ground layer 9.

Figure 7:
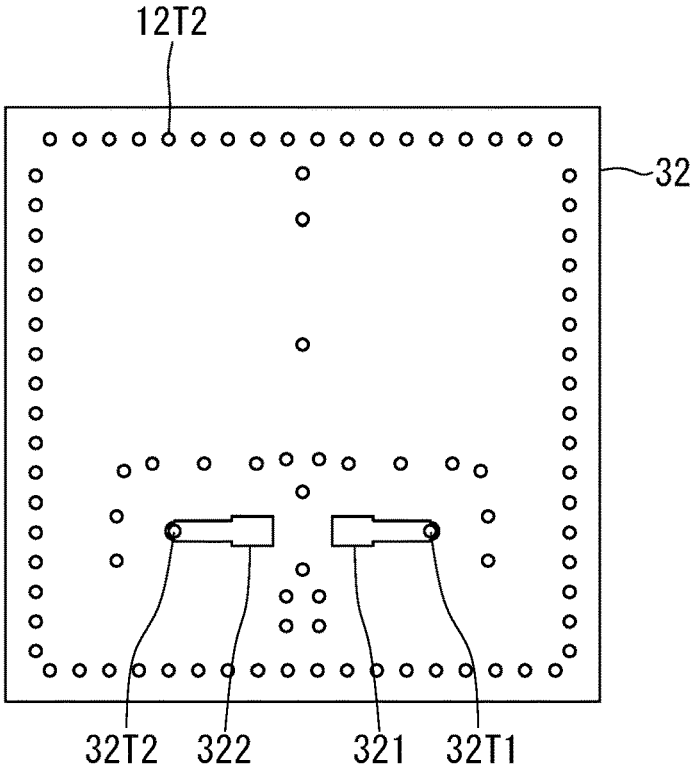
FIG. 7 is a plan view illustrating a patterned surface of a second dielectric layer of the peripheral dielectric portion shown in FIG. 1.

FIG. 7 illustrates a patterned surface of the second dielectric layer 32. On the patterned surface of the dielectric layer 32, there are formed conductor layers 321 and 322 which are long in the X direction. Each of the conductor layers 321 and 322 has a first end and a second end opposite to each other. The first end of the conductor layer 321 is opposed to the first end of the conductor layer 322. The through hole 31T1 shown in FIG. 6 is connected to a portion of the conductor layer 321 near the first end thereof. The through hole 31T2 shown in FIG. 6 is connected to a portion of the conductor layer 322 near the first end thereof.

Further formed in the dielectric layer 32 are a through hole 32T1 connected to a portion of the conductor layer 321 near the second end thereof, and a through hole 32T2 connected to a portion of the conductor layer 322 near the second end thereof. Further formed in the dielectric layer 32 are a plurality of through holes 12T2 constituting respective portions of the plurality of through hole lines 12T. All the through holes in FIG. 7 except the through holes 32T1 and 32T2 are the through holes 12T2. The through holes 12T1 shown in FIG. 6 are respectively connected to the through holes 12T2.

Figure 8:
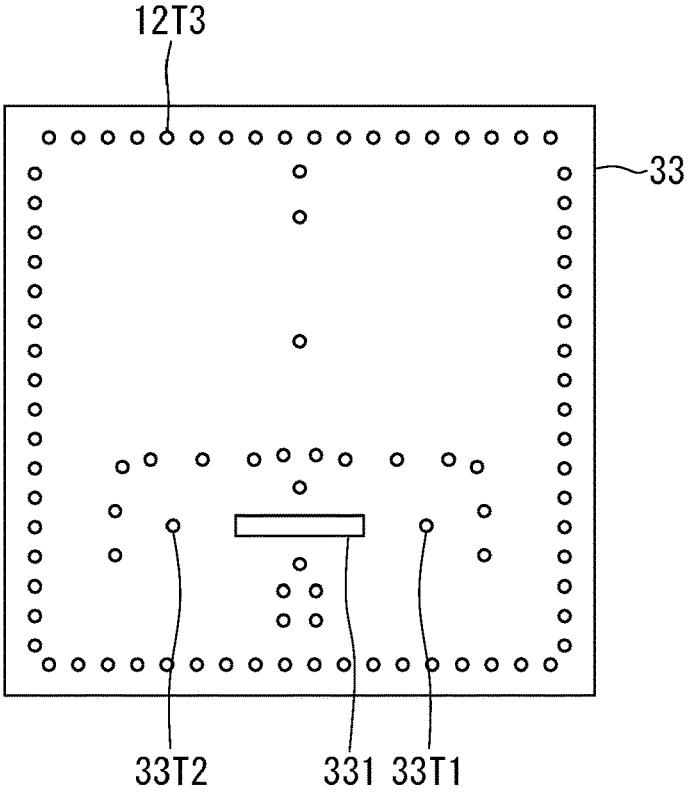
FIG. 8 is a plan view illustrating a patterned surface of a third dielectric layer of the peripheral dielectric portion shown in FIG. 1.

FIG. 8 illustrates a patterned surface of the third dielectric layer 33. A conductor layer 331 long in the X direction is formed on the patterned surface of the dielectric layer 33. A portion of the conductor layer 331 is opposed to the portion of the conductor layer 321 near the first end thereof with the dielectric layer 32 interposed therebetween. Another portion of the conductor layer 331 is opposed to the portion of the conductor layer 322 near the first end thereof with the dielectric layer 32 interposed therebetween.

Further formed in the dielectric layer 33 are through holes 33T1 and 33T2, and through holes 12T3 constituting respective portions of the through hole lines 12T. The through holes 32T1 and 32T2 shown in FIG. 7 are connected to the through holes 33T1 and 33T2, respectively. All the through holes in FIG. 8 except the through holes 33T1 and 33T2 are the through holes 12T3. The through holes 12T2 shown in FIG. 7 are respectively connected to the through holes 12T3.

Figure 9:
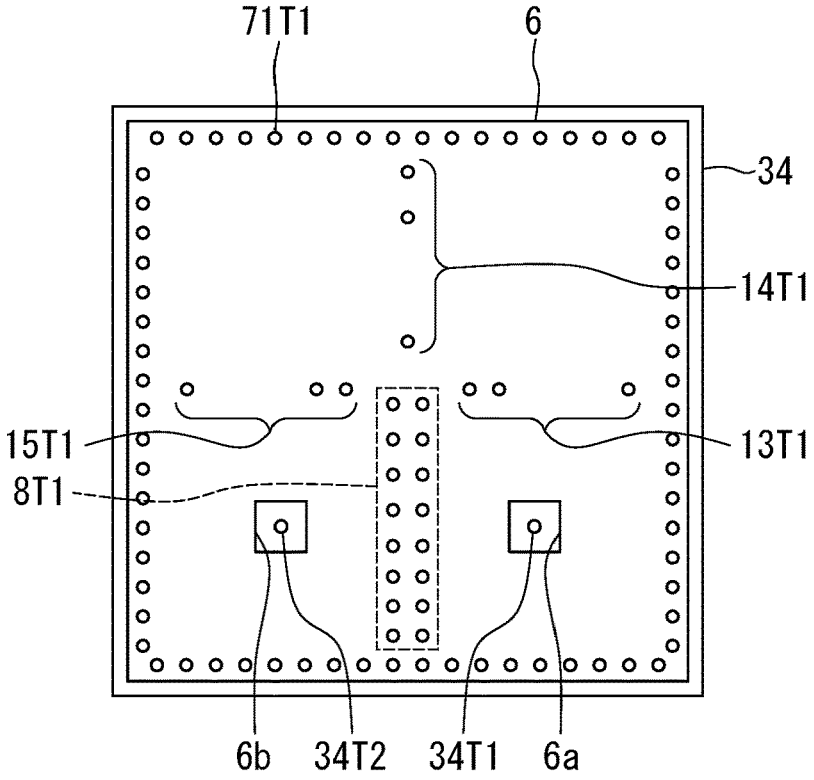
FIG. 9 is a plan view illustrating a patterned surface of a fourth dielectric layer of the peripheral dielectric portion shown in FIG. 1.

FIG. 9 illustrates a patterned surface of the fourth dielectric layer 34. The separation conductor layer 6 is formed on the patterned surface of the dielectric layer 34. Two rectangular holes 6*a* and 6*b* are formed in the separation conductor layer 6.

Through holes 34T1 and 34T2 are formed in the dielectric layer 34. Further formed in the dielectric layer 34 are through holes 8T1, 13T1, 14T1, 15T1, and 71T1 constituting respective portions of the through hole lines 8T, 13T, 14T, 15T, and 71T. All the through holes in FIG. 9 except the through holes 34T1, 34T2, 8T1, 13T1, 14T1 and 15T1 are the through holes 71T1.

The through hole 34T1 lies inside the hole 6*a*, and the through hole 34T2 lies inside the hole 6*b*. The through holes 33T1 and 33T2 shown in FIG. 8 are connected to the through holes 34T1 and 34T2, respectively.

In FIG. 9, all the through holes except the through holes 34T1 and 34T2 are connected to the separation conductor layer 6. The separation conductor layer 6 has a rectangular perimeter. The through holes 71T1 are connected to the separation conductor layer 6 at its areas near the perimeter.

Figure 10:
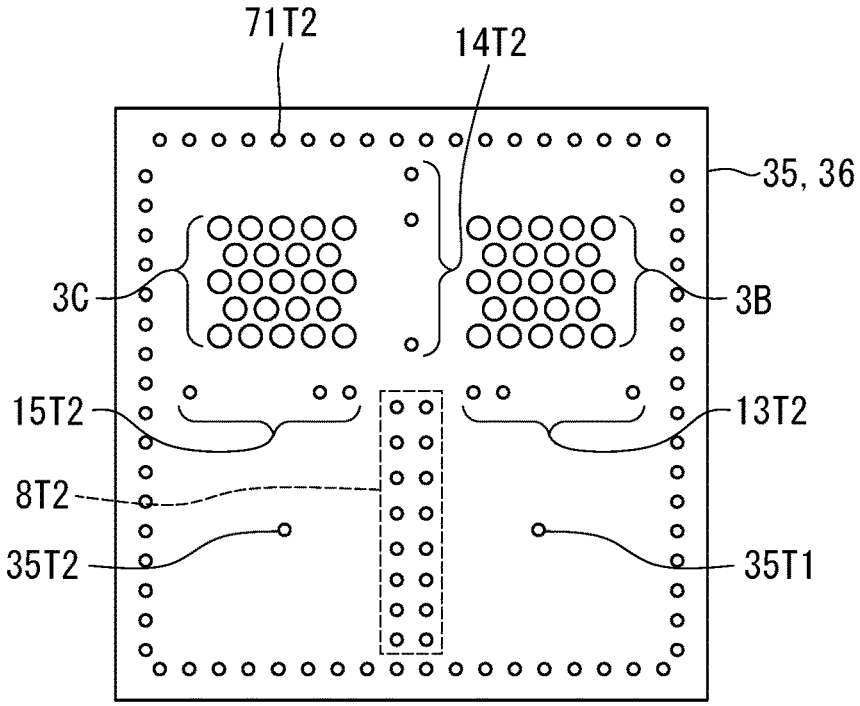
FIG. 10 is a plan view illustrating a patterned surface of each of a fifth and a sixth dielectric layer of the peripheral dielectric portion shown in FIG. 1.

FIG. 10 illustrates a patterned surface of each of the fifth and sixth dielectric layers 35 and 36. Through holes 35T1 and 35T2 are formed in each of the dielectric layers 35 and 36. Further formed in each of the dielectric layers 35 and 36 are through holes 8T2, 13T2, 14T2, 15T2, and 71T2 constituting respective portions of the through hole lines 8T, 13T, 14T, 15T, and 71T. All the through holes in FIG. 10 except the through holes 35T1, 35T2, 8T2, 13T2, 14T2 and 15T2 are the through holes 71T2.

The through holes 34T1, 34T2, 8T1, 13T1, 14T1, 15T1, and 71T1 shown in FIG. 9 are respectively connected to the through holes 35T1, 35T2, 8T2, 13T2, 14T2, 15T2, and 71T2 formed in the fifth dielectric layer 35. In the dielectric layers 35 and 36, every vertically adjacent through holes denoted by the same reference signs are connected to each other.

The resonator bodies 3B and 3C extend through the dielectric layers 35 and 36.

Figure 11:
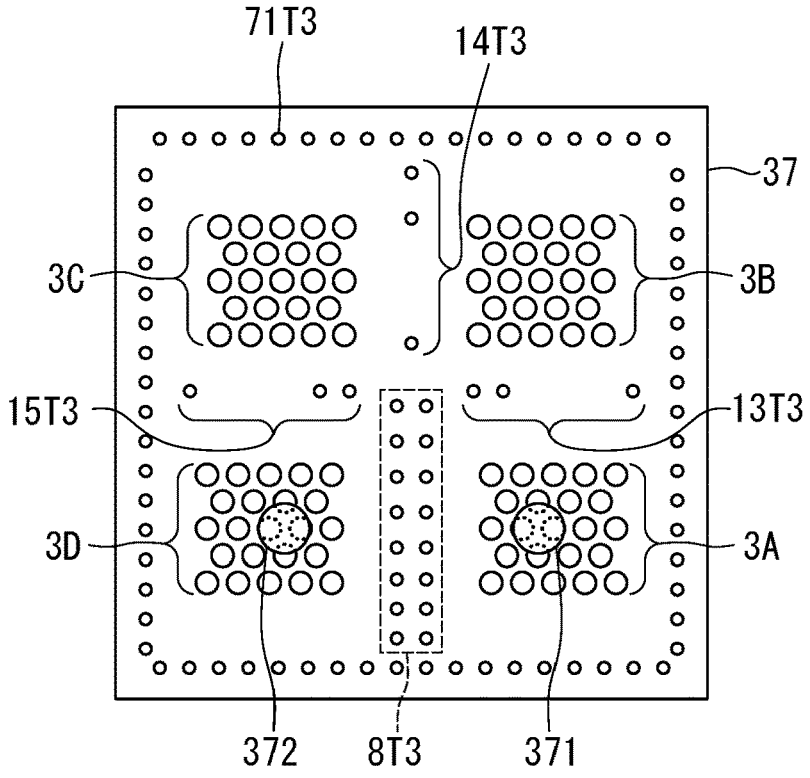
FIG. 11 is a plan view illustrating a patterned surface of a seventh dielectric layer of the peripheral dielectric portion shown in FIG. 1.

FIG. 11 illustrates a patterned surface of the seventh dielectric layer 37. Conductor layers 371 and 372 are formed on the patterned surface of the dielectric layer 37. The through holes 35T1 and 35T2 formed in the sixth dielectric layer 36 are connected to the conductor layers 371 and 372, respectively.

Further formed in the dielectric layer 37 are through holes 8T3, 13T3, 14T3, 15T3, and 71T3 constituting respective portions of the through hole lines 8T, 13T, 14T, 15T, and 71T. All the through holes in FIG. 11 except the through holes 8T3, 13T3, 14T3, and 15T3 are the through holes 71T3.

The through holes 8T2, 13T2, 14T2, 15T2, and 71T2 formed in the sixth dielectric layer 36 are respectively connected to the through holes 8T3, 13T3, 14T3, 15T3, and 71T3 formed in the dielectric layer 37.

The resonator bodies 3A to 3D extend through the dielectric layer 37.

Figure 12:
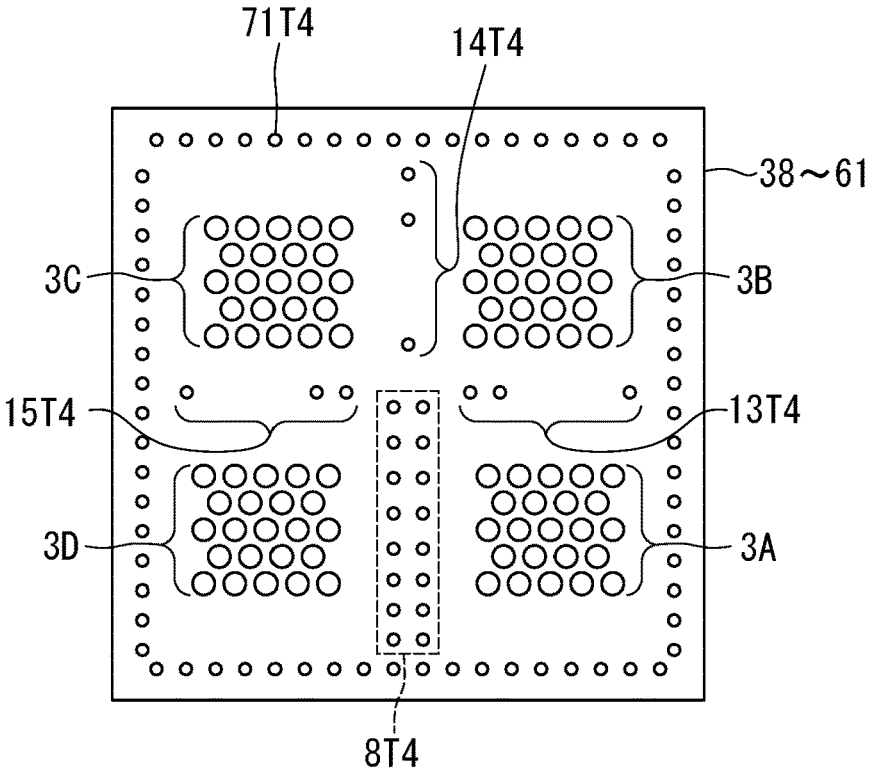
FIG. 12 is a plan view illustrating a patterned surface of each of an eighth to a thirty-first dielectric layer of the peripheral dielectric portion shown in FIG. 1.

FIG. 12 illustrates a patterned surface of each of the eighth to thirty-first dielectric layers 38 to 61. In each of the dielectric layers 38 to 61, there are formed through holes 8T4, 13T4, 14T4, 15T4, and 71T4 constituting respective portions of the through hole lines 8T, 13T, 14T, 15T, and 71T. All the through holes in FIG. 12 except the through holes 8T4, 13T4, 14T4, and 15T4 are the through holes 71T4.

The through holes 8T3, 13T3, 14T3, 15T3, and 71T3 shown in FIG. 11 are respectively connected to the through holes 8T4, 13T4, 14T4, 15T4, and 71T4 formed in the eighth dielectric layer 38. In the dielectric layers 38 to 61, every vertically adjacent through holes denoted by the same reference signs are connected to each other.

The resonator bodies 3A to 3D extend through the dielectric layers 38 to 61.

Figure 13:
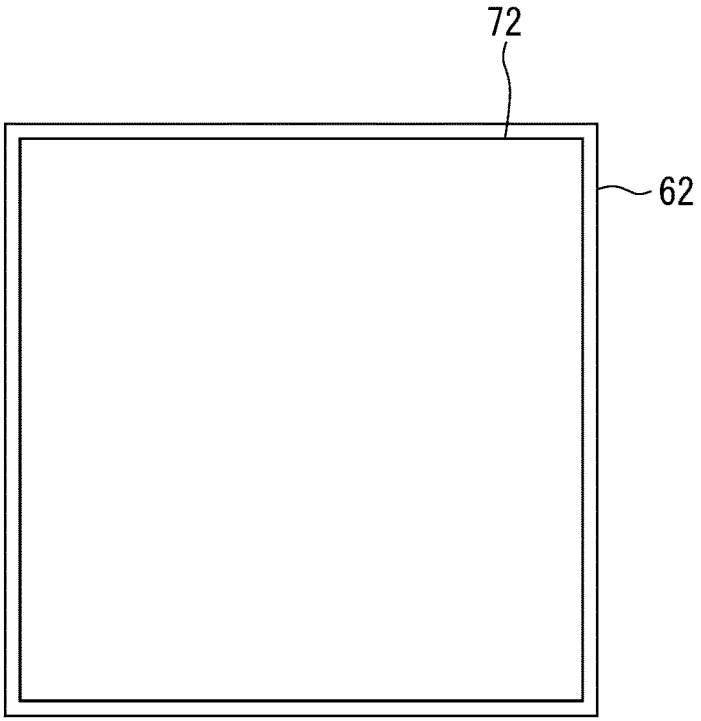
FIG. 13 is a plan view illustrating a patterned surface of a thirty-second dielectric layer of the peripheral dielectric portion shown in FIG. 1.

FIG. 13 illustrates a patterned surface of the thirty-second dielectric layer 62. The shield conductor layer 72 is formed on the patterned surface of the dielectric layer 62. The through holes 8T4, 13T4, 14T4, 15T4, and 71T4 formed in the thirty-first dielectric layer 61 are connected to the shield conductor layer 72.

The peripheral dielectric portion 4 is formed by stacking the dielectric layers 31 to 62 such that the patterned surface of the dielectric layer 31 shown in FIG. 6 constitutes the bottom surface 4*a* of the peripheral dielectric portion 4.

The resonator bodies 3A and 3D extend through the dielectric layers 37 to 61. The resonator bodies 3B and 3C extend through the dielectric layers 35 to 61. The conductor layer 371 is in contact with the bottom end faces of some of the individual elements 30 included in the resonator body 3A. The conductor layer 372 is in contact with the bottom end faces of some of the individual elements 30 included in the resonator body 3D. The top end faces of all the individual elements 30 included in the resonator bodies 3A to 3D are in contact with the shield conductor layer 72.

The capacitor C10 shown in FIG. 5 is composed of the conductor layer 331 shown in FIG. 8, the conductor layers 321 and 322 shown in FIG. 7, and the dielectric layer 32 interposed between the conductor layer 331 and the conductor layers 321, 322. The capacitor C10 lies in the area between the separation conductor layer 6 and the ground layer 9 within the structure 20. As previously mentioned, the resonator bodies 3A to 3D lie in the area between the separation conductor layer 6 and the shield conductor layer 72 within the structure 20. The separation conductor layer 6 thus separates the area where the resonator bodies 3A to 3D lie from the area where the capacitor C10 lies.

Some of the plurality of through hole lines 12T constituting the connection portion 12 are arranged to surround the conductor layers 321, 322, and 331 constituting the capacitor C10.

As shown in FIG. 3, the conductor layer 321 and the conductor layer 371 are connected to each other by a through hole line 11AT constituted of the through holes 32T1, 33T1, 34T1 and 35T1 connected in series. The conductor layer 322 and the conductor layer 372 are connected to each other by a through hole line 11BT constituted of the through holes 32T2, 33T2, 34T2 and 35T2 connected in series.

The first phase shifter 11A is composed of the conductor layer 321 and the through hole line 11AT. The second phase shifter 11B is composed of the conductor layer 322 and the through hole line 11BT.

It should be noted that the dielectric layers 31, 32 and 33 need not necessarily be used as constituents of the peripheral dielectric portion 4, and the peripheral dielectric portion 4 may thus be constituted of the dielectric layers 34 to 62 stacked. In such a case, the dielectric forming the dielectric layers 31, 32 and 33 may have a relative permittivity higher than or equal to the first relative permittivity of the first dielectric forming the resonator bodies 3A to 3D.

Next, first and second examples of methods for manufacturing the dielectric filter 1 according to the present embodiment will be described. Both of the first and second examples include a step of fabricating an unfired multilayer stack which is to be fired later into the structure 20, and a step of subjecting the unfired multilayer stack to firing to complete the structure 20. The first example and the second example are different in the content of the step of fabricating the unfired multilayer stack.

In the first example, the step of fabricating the unfired multilayer stack starts with fabricating a plurality of unfired ceramic sheets, which are to become the dielectric layers 31 to 62 later. Next, a plurality of unfired through holes are formed in ones of the ceramic sheets that correspond to ones of the dielectric layers that each have a plurality of through holes formed therein. Further, a plurality of holes for accommodating respective portions of the individual elements 30 included in the resonator bodies 3B and 3C are formed in each of two of the ceramic sheets that are to become the dielectric layers 35 and 36. Further, a plurality of holes for accommodating respective portions of the individual elements 30 included in the resonator bodies 3A to 3D are formed in each of twenty-five of the ceramic sheets that are to become the dielectric layers 37 to 61. Then, the plurality of holes formed in each of those ceramic sheets to become the dielectric layers 35 to 61 are filled with a material that is to become the first dielectric when fired later. Further, one or more unfired conductor layers are formed on ones of the ceramic sheets that correspond to ones of the dielectric layers that each have one or more conductor layers formed thereon. The plurality of unfired ceramic sheets processed as above are then stacked together to complete the unfired multilayer stack.

In the second example, the step of fabricating the unfired multilayer stack starts with fabricating a plurality of unfired ceramic sheets, which are to become the dielectric layers 31 to 62 later. Next, a plurality of unfired through holes are formed in ones of the ceramic sheets that correspond to ones of the dielectric layers that each have a plurality of through holes formed therein. Further, one or more unfired conductor layers are formed on ones of the ceramic sheets that correspond to ones of the dielectric layers that each have one or more conductor layers formed thereon, the one or more conductor layers being other than the conductor layers 371 and 372.

Next, twenty-five of the ceramic sheets that are to become the dielectric layers 37 to 61 are stacked together to form a first initial multilayer stack. A plurality of holes for accommodating the individual elements 30 included in the resonator bodies 3A and 3D are formed in the first initial multilayer stack. The plurality of holes are then filled with a material that is to become the first dielectric when fired later. Next, two unfired conductor layers corresponding to the conductor layers 371 and 372 are formed on one of the ceramic sheets that is to become the dielectric layer 37, the one of the ceramic sheets lying at an end in the stacking direction of the first initial multilayer stack.

Then, two of the ceramic sheets that are to become the dielectric layers 35 and 36 are stacked on the first initial multilayer stack to form a second initial multilayer stack. A plurality of holes for accommodating the individual elements 30 included in the resonator bodies 3B and 3C are formed in the second initial multilayer stack. The plurality of holes are then filled with the material that is to become the first dielectric when fired later.

Next, four of the ceramic sheets that are to become the dielectric layers 31 to 34 and one of the ceramic sheets that is to become the dielectric layer 62 are stacked on the second initial multilayer stack to thereby complete the unfired multilayer stack.

The dielectric filter 1 according to the present embodiment has a band-pass filter function. The dielectric filter 1 is designed and configured to have a passband in, for example, a quasi-millimeter wave band of 10 to 30 GHz or a millimeter wave band of 30 to 300 GHz. Note that the passband refers to, for example, a frequency band between two frequencies at which the insertion loss is higher by 3 dB than the minimum value of the insertion loss. Each of the dielectric resonators 2A to 2D is designed and configured to have a resonant frequency in, for example, a quasi-millimeter wave band of 10 to 30 GHz or a millimeter wave band of 30 to 300 GHz. The center frequency of the passband of the dielectric filter 1 depends on the resonant frequency of each of the dielectric resonator 2A to 2D, and is close to the resonant frequency.

Figure 14:
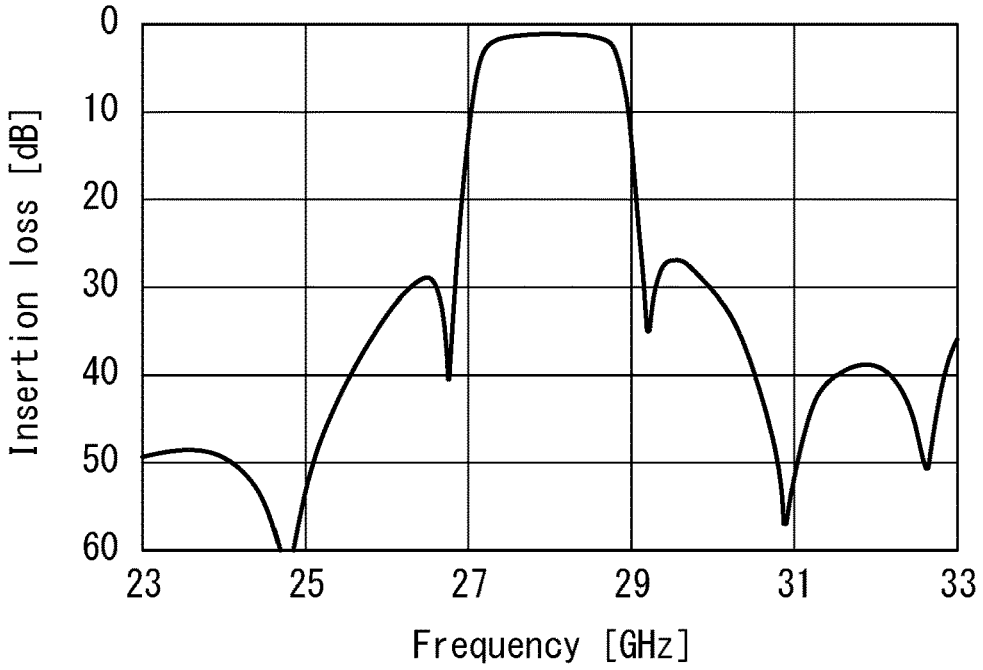
FIG. 14 is a characteristic diagram illustrating an example of the frequency response of the insertion loss of the dielectric filter according to the first embodiment of the invention.

FIG. 14 illustrates an example of the frequency response of the insertion loss of the dielectric filter 1. In FIG. 14, the horizontal axis represents frequency, and the vertical axis represents insertion loss.

Next, the features of the dielectric resonators 2A to 2D and the dielectric filter 1 according to the present embodiment will be described. In the present embodiment, each of the resonator bodies 3A to 3D includes a plurality of individual elements 30 separated from each other. This makes it possible to reduce a variation in the resonant frequency of each of the dielectric resonators 2A to 2D resulting from a variation in the volume of each of the resonator bodies 3A to 3D, and to thereby reduce a variation in the passband of the dielectric filter 1, compared to when each of the resonator bodies 3A to 3D is constructed of a single block of dielectric.

The foregoing effect will be described in detail below with reference to the results of a first simulation. In the first simulation, a model of a dielectric resonator of a comparative example and a model of the dielectric resonator according to the present embodiment were compared in terms of variations in the resonant frequency of the dielectric resonators resulting from variations in the volume of the resonator bodies. In the first simulation, variations were expressed by the ratio of a standard deviation to a design value. Hereinafter, the model of the dielectric resonator of the comparative example will be referred to as the comparative example model, and the model of the dielectric resonator according to the present embodiment will be referred to as the first example model.

Figure 15:
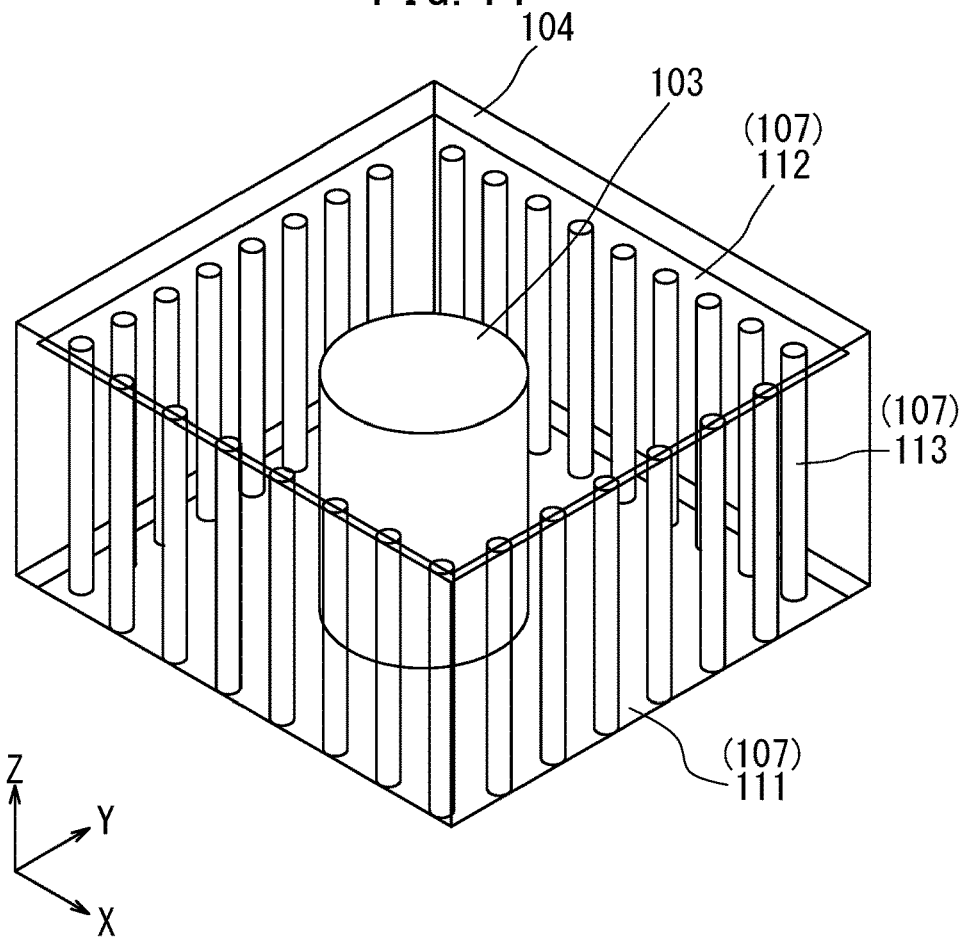
FIG. 15 RELATED ART
FIG. 15 is a perspective view of a model of a comparative example.

First, the configuration of the comparative example model will be described with reference to FIG. 15. FIG. 15 is a perspective view of the comparative example model. The comparative example model has a resonator body 103 formed of the first dielectric, a peripheral dielectric portion 104 formed of the second dielectric, and a shield portion 107 formed of a conductor.

The resonator body 103 is in the shape of a cylinder with its central axis in the Z direction. The peripheral dielectric portion 104 lies around the resonator body 103. The shield portion 107 lies around the resonator body 103 such that at least part of the peripheral dielectric portion 104 is interposed between the resonator body 103 and the shield portion 107.

The shield portion 107 includes two conductor layers 111 and 112 spaced apart from each other in the Z direction, and a plurality of through hole lines 113 connecting the conductor layers 111 and 112.

Figure 16:
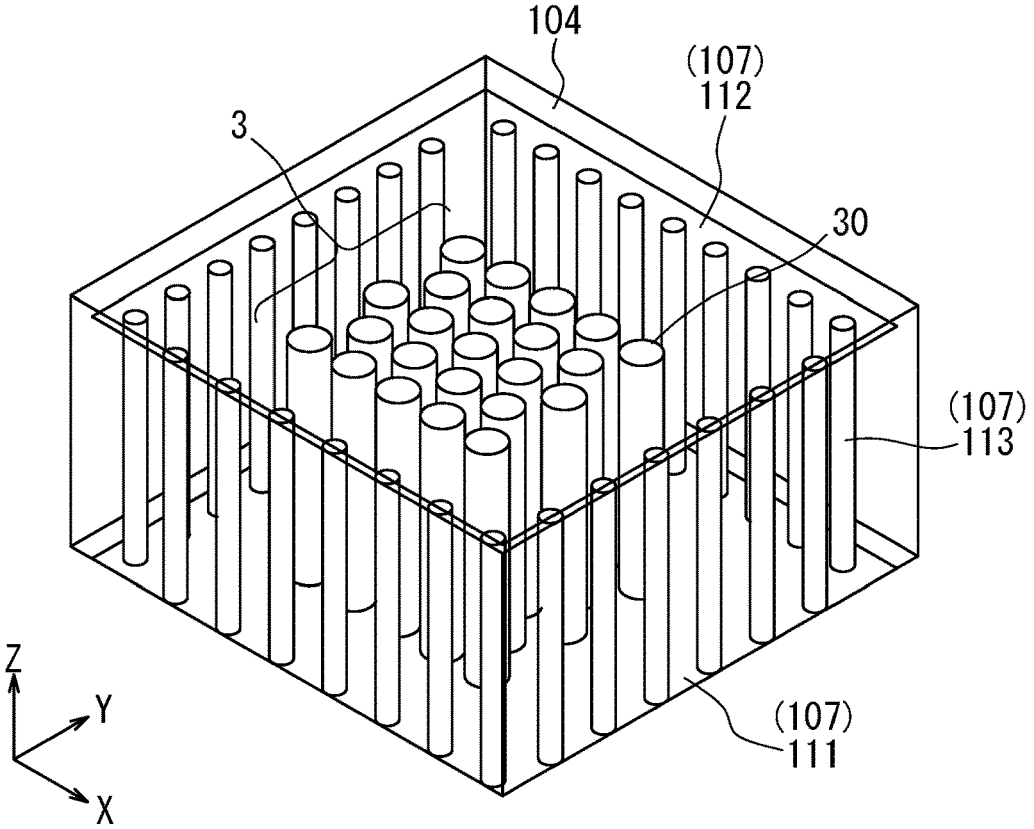
FIG. 16 is a perspective view of a model of a first example.
Figure 17:
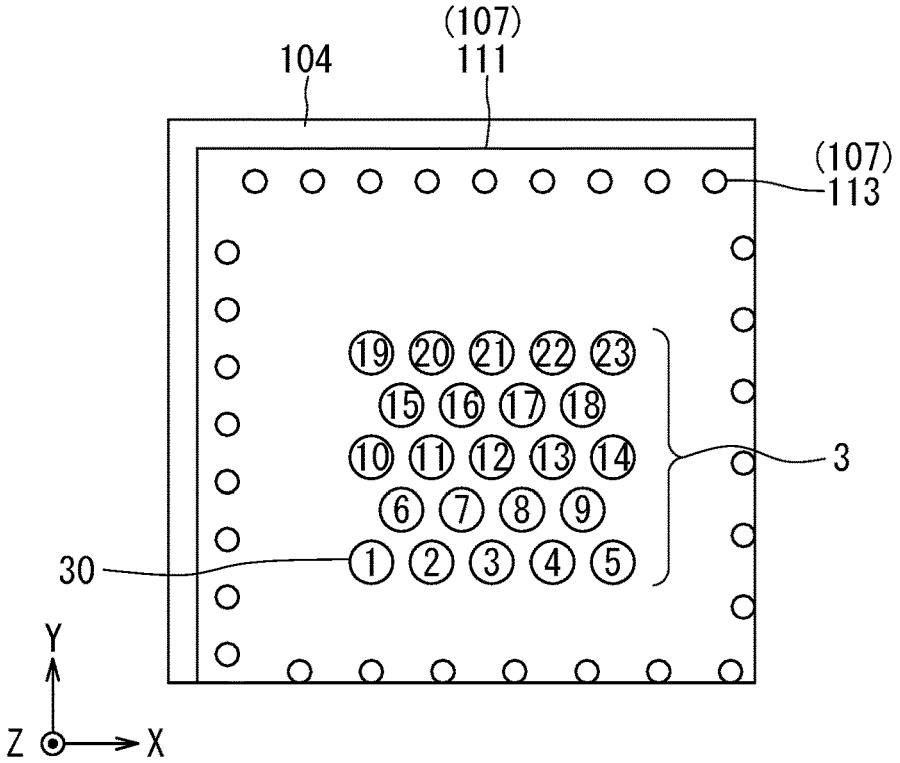
FIG. 17 is a plan view of the model of the first example.

Next, the configuration of the first example model will be described with reference to FIGS. 16 and 17. FIG. 16 is a perspective view of the first example model. FIG. 17 is a plan view of the first example model. The first example model has a resonator body 3 formed of the first dielectric, a peripheral dielectric portion 104, and a shield portion 107.

The resonator body 3 includes twenty-three individual elements 30. The resonator body 3 has the same configuration as the resonator body 3B. The first example model corresponds to the dielectric resonator 2B.

The configurations of the peripheral dielectric portion 104 and the shield portion 107 of the first example model are the same as those of the comparative example model.

FIG. 17 omits the illustration of the conductor layer 112.

In the first simulation, as shown in FIG. 17, the twenty-three individual elements 30 were numbered 1 to 23 for the sake of distinction from each other.

In the first simulation, the comparative example model and the first example model were designed to have approximately equal resonant frequencies.

In the comparative example model, the diameter of a cross section of the resonator body 103 perpendicular to the Z direction was 570 μm in design value. The resonant frequency of the comparative example model was 29674 MHz in design value.

In the first example model, the diameter of a cross section of each of the twenty-three individual elements 30 perpendicular to the Z direction was 150 μm in design value. The resonant frequency of the first example model was 29616 MHz in design value.

In the first simulation, it was assumed for the comparative example model that the diameter of the cross section of the resonator body 103 had a variation of 10%. In such a case, the volume of the resonator body 103 varies by 21%. The standard deviation of the resonant frequency of the comparative example model was 1248 MHz. The resulting variation in the resonant frequency of the comparative example model was 4.2%.

In the first simulation, it was assumed for the first example model that the diameter of the cross section of each of the individual elements 30 had a variation of 10%. In such a case, the variation in the diameter of the cross section of a single individual element 30 results in a variation of 0.9% in the volume of the resonator body 3. Note that the volume of the resonator body 3 refers to the total of the volumes of the twenty-three individual elements 30.

In the first simulation, a standard deviation σfn of the resonant frequency resulting from the variation in the diameter of the cross section of a single individual element 30 was determined for the first example model. The standard deviation σfn of the resonant frequency varies from one individual element 30 to another. This is because the effect of a change in the diameter of the cross section of an individual element 30 on the resonant frequency varies depending on the position of the individual element 30 in the resonator body 3. Table 1 below shows standard deviations σfn for the individual elements numbered 1 to 23 as shown in FIG. 17.

TABLE 1

| No. | 1 | 2 | 3 | 4 | 5 | 6 | 7 | 8 |
|---|---|---|---|---|---|---|---|---|
| σfn (MHz) | 31 | 50 | 58 | 49 | 26 | 72 | 101 | 98 |
| No. | 9 | 10 | 11 | 12 | 13 | 14 | 15 | 16 |
| σfn (MHz) | 68 | 66 | 112 | 130 | 110 | 60 | 88 | 120 |
| No. | 17 | 18 | 19 | 20 | 21 | 22 | 23 | |
| σfn (MHz) | 119 | 82 | 47 | 78 | 89 | 75 | 43 | |

Next, in the first simulation, a standard deviation of the resonant frequency resulting from the variations in the diameters of the cross sections of the twenty-three individual elements 30 was determined for the first example model. From the additivity of variances, the standard deviation of the resonant frequency is given by the square root of the sum of the squares of the respective standard deviations σfn for the individual elements numbered 1 to 23 shown in Table 1. The standard deviation of the resonant frequency was 395 MHz. The resulting variation in the resonant frequency of the first example model was 1.3%. Thus, the variation in the resonant frequency of the first example model was smaller than that of the comparative example model.

From the results of the first simulation, it can be seen that the present embodiment enables reduction of a variation in the resonant frequency of each of the dielectric resonators 2A to 2D resulting from a variation in the volume of each of the resonator bodies 3A to 3D, compared to when each of the resonator bodies 3A to 3D is constructed of a single block of dielectric.

Other features of the dielectric filter 1 according to the present embodiment will now be described. The dielectric filter 1 includes the four dielectric resonators 2A to 2D configured so that two dielectric resonators adjacent to each other in circuit configuration are magnetically coupled to each other, and the capacitor C10 for capacitively coupling the first input/output port 5A and the second input/output port 5B. The dielectric filter 1 of such a configuration is able to provide a first attenuation pole and a second attenuation pole in the frequency response of the insertion loss. The first attenuation pole occurs in a first passband-neighboring region, which is a frequency region close to the passband and lower than the passband. The second attenuation pole occurs in a second passband-neighboring region, which is a frequency region close to the passband and higher than the passband. Note that the number of the dielectric resonators required for providing the first and second attenuation poles is not limited to four but can be any even number.

The frequency response of the insertion loss of the dielectric filter 1 is adjustable by adjusting the phase change amounts to be obtained at the first and second phase shifters 11A and 11B. The phase change amounts at the first and second phase shifters 11A and 11B are changeable by changing the lengths of the first and second phase shifters 11A and 11B.

Second Embodiment

Figure 18:
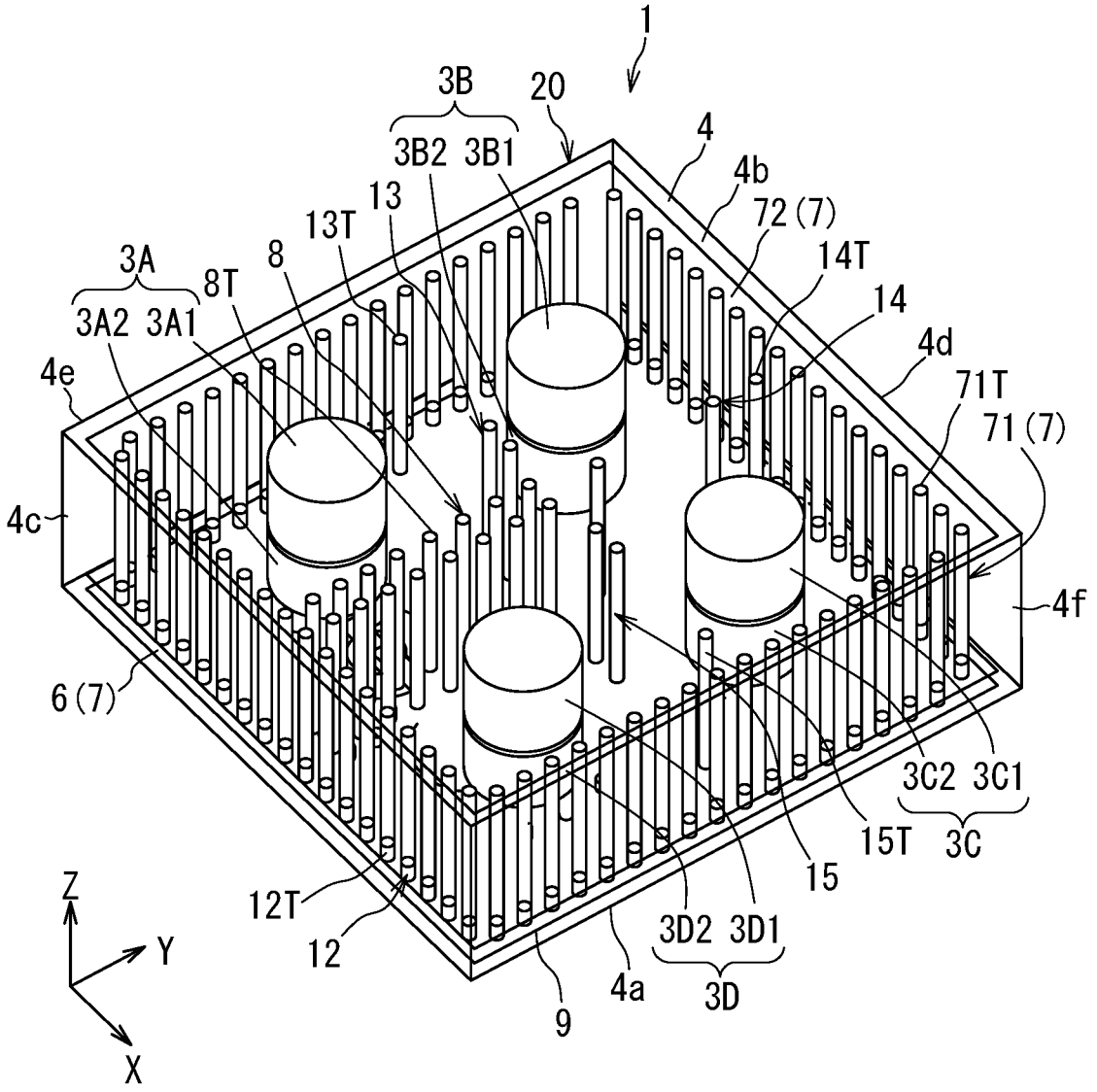
FIG. 18 is a perspective view illustrating the interior of a dielectric filter according to a second embodiment of the invention.
Figure 19:
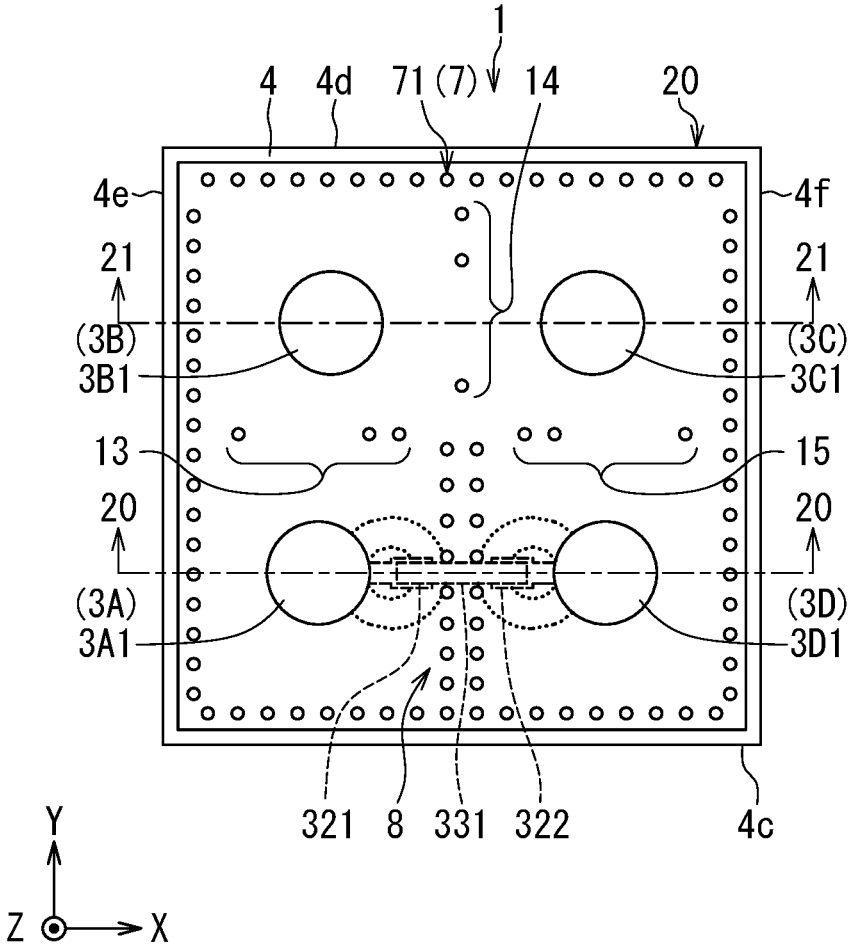
FIG. 19 is a plan view illustrating the interior of the dielectric filter according to the second embodiment of the invention.
Figure 20:
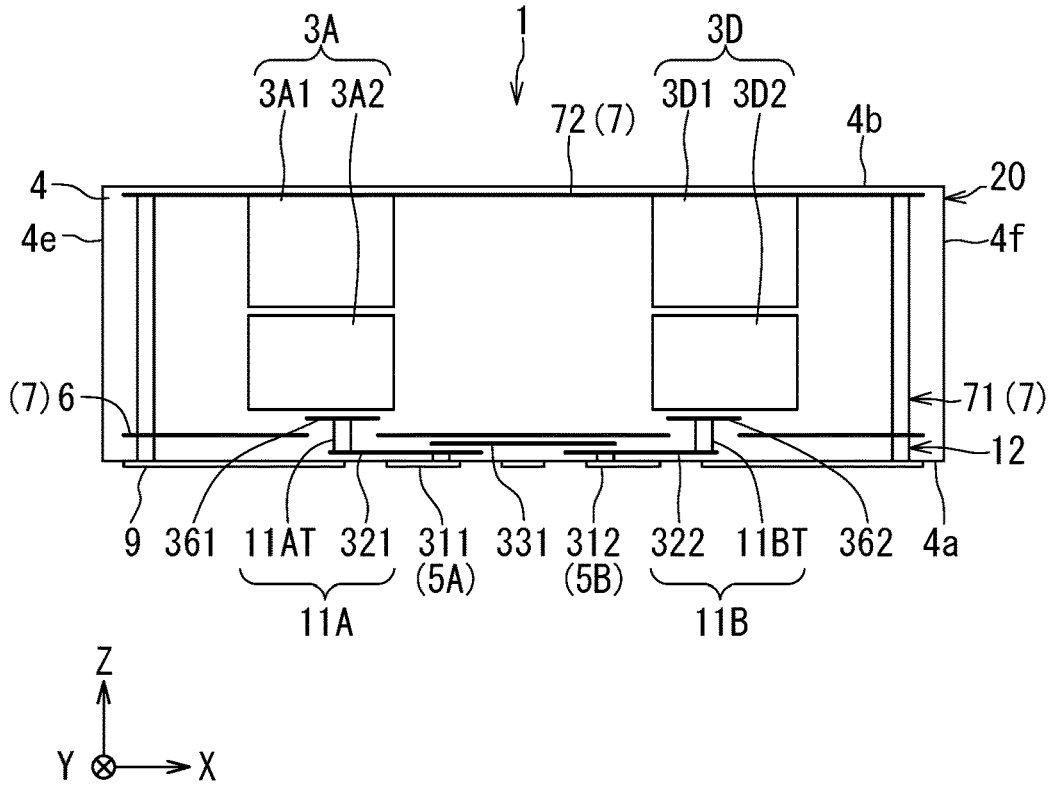
FIG. 20 is a cross-sectional view illustrating a cross section of the dielectric filter taken along line 20-20 of FIG. 19.
Figure 21:
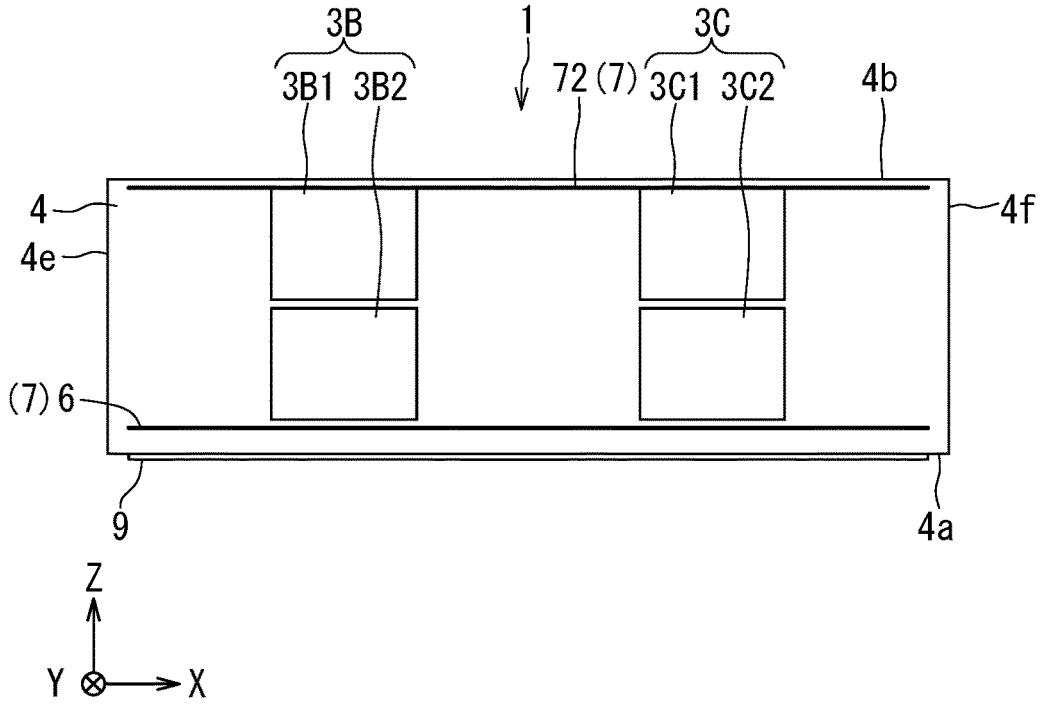
FIG. 21 is a cross-sectional view illustrating a cross section of the dielectric filter taken along line 21-21 of FIG. 19.
Figure 22:
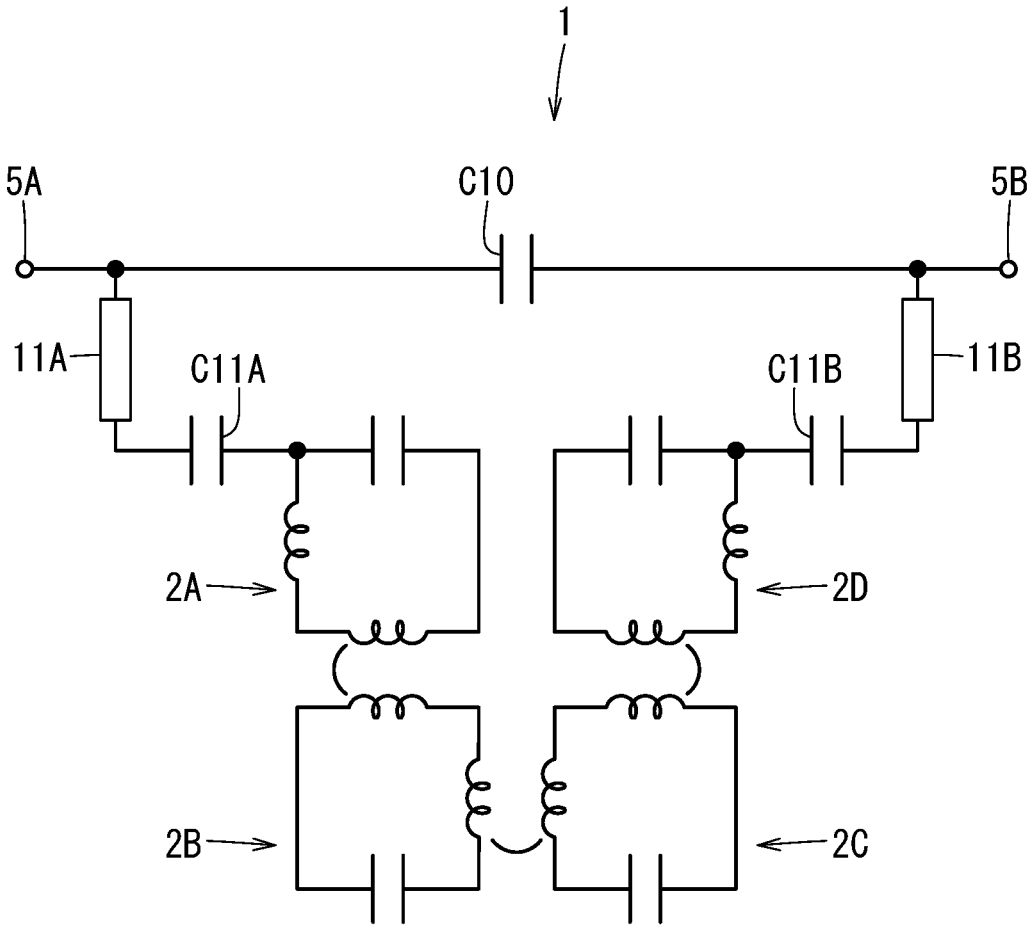
FIG. 22 is a circuit diagram illustrating an equivalent circuit of the dielectric filter according to the second embodiment of the invention.

A second embodiment of the invention will now be described. FIG. 18 is a perspective view illustrating the interior of a dielectric filter according to the second embodiment. FIG. 19 is a plan view illustrating the interior of the dielectric filter according to the second embodiment. FIG. 20 is a cross-sectional view illustrating a cross section of the dielectric filter taken along line 20-20 of FIG. 19. FIG. 21 is a cross-sectional view illustrating a cross section of the dielectric filter taken along line 21-21 of FIG. 19. FIG. 22 is a circuit diagram illustrating an equivalent circuit of the dielectric filter according to the second embodiment.

The dielectric filter 1 according to the present embodiment differs from the dielectric filter 1 according to the first embodiment in the following ways. In the dielectric filter 1 according to the present embodiment, each of the resonator bodies 3A to 3D has a different configuration from that in the first embodiment. In the present embodiment, each of the resonator bodies 3A to 3D includes a plurality of individual elements separated from each other and aligned in the first direction, i.e., the Z direction. All the plurality of individual elements may have a rotationally symmetrical shape with respect to an axis in the same direction, e.g., the Z direction. The first direction, i.e., the Z direction, is the direction of propagation of electromagnetic waves in each of the dielectric resonators 2A to 2D.

In each of the resonator bodies 3A to 3D, the distance between adjacent two of the plurality of individual elements may be less than or equal to a quarter of a wavelength corresponding to the resonant frequency of a corresponding one of the dielectric resonators 2A to 2D inside the peripheral dielectric portion 4.

In the present embodiment, specifically, the resonator body 3A includes two individual elements 3A1 and 3A2 aligned in the Z direction. Likewise, the resonator body 3B includes two individual elements 3B1 and 3B2 aligned in the Z direction. The resonator body 3C includes two individual elements 3C1 and 3C2 aligned in the Z direction. The resonator body 3D includes two individual elements 3D1 and 3D2 aligned in the Z direction.

The individual element 3A1 lies above the individual element 3A2. The individual element 3B1 lies above the individual element 3B2. The individual element 3C1 lies above the individual element 3C2. The individual element 3D1 lies above the individual element 3D2.

Each of the individual elements 3A1, 3A2, 3B1, 3B2, 3C1, 3C2, 3D1, and 3D2 has a rotationally symmetrical shape with respect to an axis in the Z direction. Examples of such a shape include a cylindrical shape and a regular polygonal columnar shape. FIG. 18 shows an example where the individual elements 3A1, 3A2, 3B1, 3B2, 3C1, 3C2, 3D1, and 3D2 each have a cylindrical shape. The central axes of the individual elements 3A1 and 3A2 are collinear. The central axes of the individual elements 3B1 and 3B2 are collinear. The central axes of the individual elements 3C1 and 3C2 are collinear. The central axes of the individual elements 3D1 and 3D2 are collinear.

Each of the individual elements 3A1, 3A2, 3B1, 3B2, 3C1, 3C2, 3D1, and 3D2 has a bottom end face closest to the separation conductor layer 6, and a top end face closest to the shield conductor layer 72. The bottom end face of the individual element 3A1 faces the top end face of the individual element 3A2. The bottom end face of the individual element 3B1 faces the top end face of the individual element 3B2. The bottom end face of the individual element 3C1 faces the top end face of the individual element 3C2. The bottom end face of the individual element 3D1 faces the top end face of the individual element 3D2.

FIG. 22 is a circuit diagram illustrating an equivalent circuit of the dielectric filter 1 according to the present embodiment. In the present embodiment, the first phase shifter 11A is configured to be capacitively coupled to the first input/output stage resonator 2A, and the second phase shifter 11B is configured to be capacitively coupled to the second input/output stage resonator 2D. In FIG. 22, the capacitor symbol C11A represents the capacitive coupling between the first phase shifter 11A and the first input/output stage resonator 2A, and the capacitor symbol C11B represents the capacitive coupling between the second phase shifter 11B and the second input/output stage resonator 2D. The configuration of the equivalent circuit shown in FIG. 22 is otherwise the same as that in FIG. 5.

The peripheral dielectric portion 4 in the present embodiment includes a multilayer stack composed of a plurality of dielectric layers stacked together, as in the first embodiment.

Reference is now made to FIGS. 23 to 27 to describe an example of the plurality of dielectric layers constituting the peripheral dielectric portion 4 of the present embodiment and an example of the configurations of a plurality of conductor layers formed on the dielectric layers and a plurality of through holes formed in the dielectric layers. In this example, the peripheral dielectric portion 4 includes a first to a thirty-second dielectric layers 31 to 62 as in the first embodiment. In FIGS. 23 to 27, each small circle represents a through hole.

The configurations of the first to fourth dielectric layers 31 to 34 and the conductor layers and through holes formed thereon/therein are the same as those in the first embodiment, and as illustrated in FIGS. 6 to 9.

Figure 23:
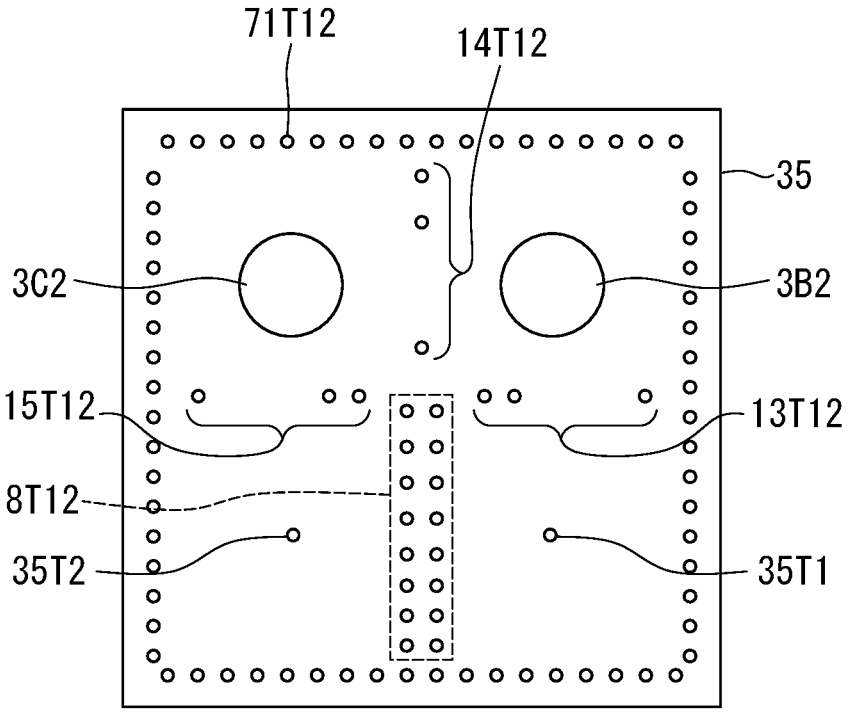
FIG. 23 is a plan view illustrating a patterned surface of a fifth dielectric layer of a peripheral dielectric portion shown in FIG. 18.

FIG. 23 illustrates a patterned surface of the fifth dielectric layer 35. Through holes 35T1 and 35T2 are formed in the dielectric layer 35. Further formed in the dielectric layer 35 are through holes 8T12, 13T12, 14T12, 15T12, and 71T12 constituting respective portions of the through hole lines 8T, 13T, 14T, 15T, and 71T. All the through holes in FIG. 23 except the through holes 35T1, 35T2, 8T12, 13T12, 14T12 and 15T12 are the through holes 71T12.

The through holes 34T1, 34T2, 8T1, 13T1, 14T1, 15T1, and 71T1 formed in the fourth dielectric layer 34 shown in FIG. 9 are connected to the through holes 35T1, 35T2, 8T12, 13T12, 14T12, 15T12, and 71T12, respectively.

The individual elements 3B2 and 3C2 extend through the dielectric layer 35.

Figure 24:
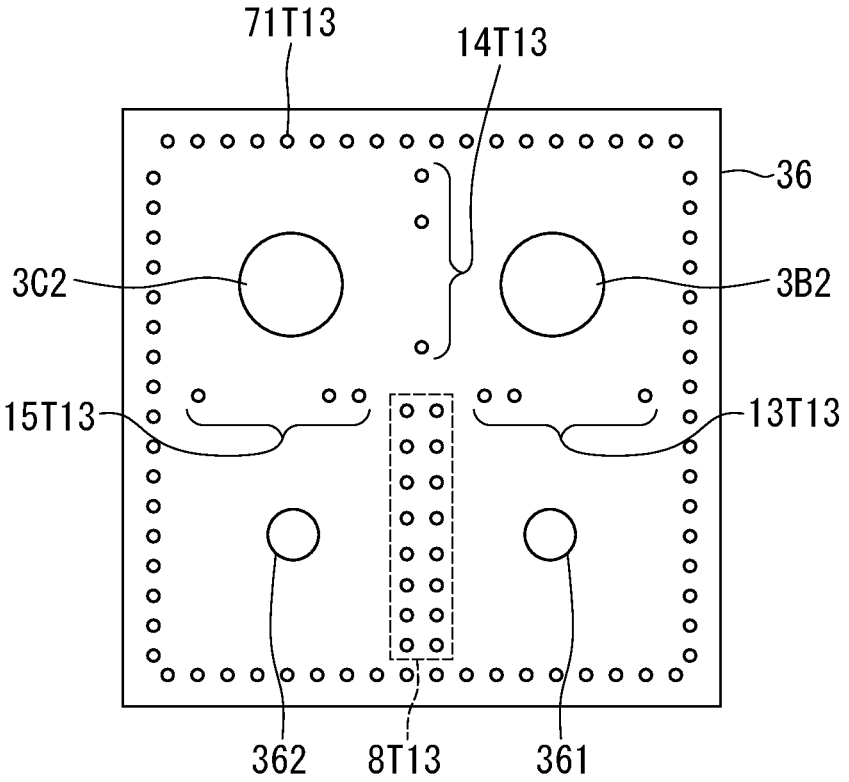
FIG. 24 is a plan view illustrating a patterned surface of a sixth dielectric layer of the peripheral dielectric portion shown in FIG. 18.

FIG. 24 illustrates a patterned surface of the sixth dielectric layer 36. Conductor layers 361 and 362 are formed on the patterned surface of the dielectric layer 36. The through holes 35T1 and 35T2 shown in FIG. 23 are connected to the conductor layers 361 and 362, respectively.

Further formed in the dielectric layer 36 are through holes 8T13, 13T13, 14T13, 15T13, and 71T13 constituting respective portions of the through hole lines 8T, 13T, 14T, 15T, and 71T. All the through holes in FIG. 24 except the through holes 8T13, 13T13, 14T13, and 15T13 are the through holes 71T13.

The through holes 8T12, 13T12, 14T12, 15T12, and 71T12 shown in FIG. 23 are connected to the through holes 8T13, 13T13, 14T13, 15T13, and 71T13, respectively.

The individual elements 3B2 and 3C2 extend through the dielectric layer 36.

Figure 25:
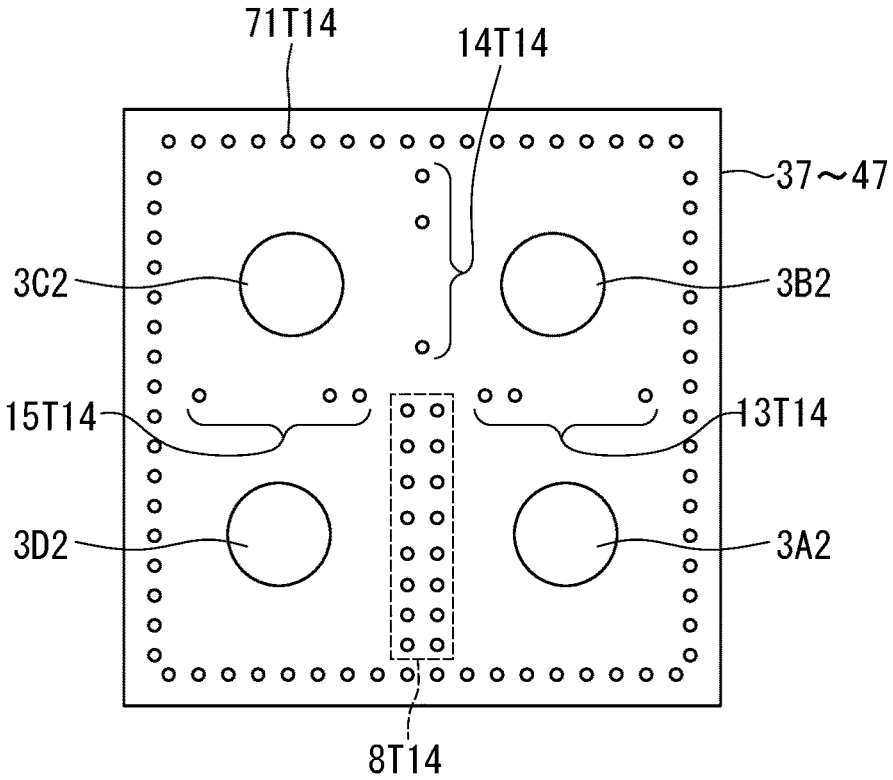
FIG. 25 is a plan view illustrating a patterned surface of each of a seventh to a seventeenth dielectric layer of the peripheral dielectric portion shown in FIG. 18.

FIG. 25 illustrates a patterned surface of each of the seventh to seventeenth dielectric layers 37 to 47. In each of the dielectric layers 37 to 47, there are formed through holes 8T14, 13T14, 14T14, 15T14, and 71T14 constituting respective portions of the through hole lines 8T, 13T, 14T, 15T, and 71T. All the through holes in FIG. 25 except the through holes 8T14, 13T14, 14T14, and 15T14 are the through holes 71T14.

The through holes 8T13, 13T13, 14T13, 15T13, and 71T13 shown in FIG. 24 are respectively connected to the through holes 8T14, 13T14, 14T14, 15T14, and 71T14 formed in the seventh dielectric layer 37. In the dielectric layers 37 to 47, every vertically adjacent through holes denoted by the same reference signs are connected to each other.

The individual elements 3A2, 3B2, 3C2, and 3D2 extend through the dielectric layers 37 to 47.

Figure 26:
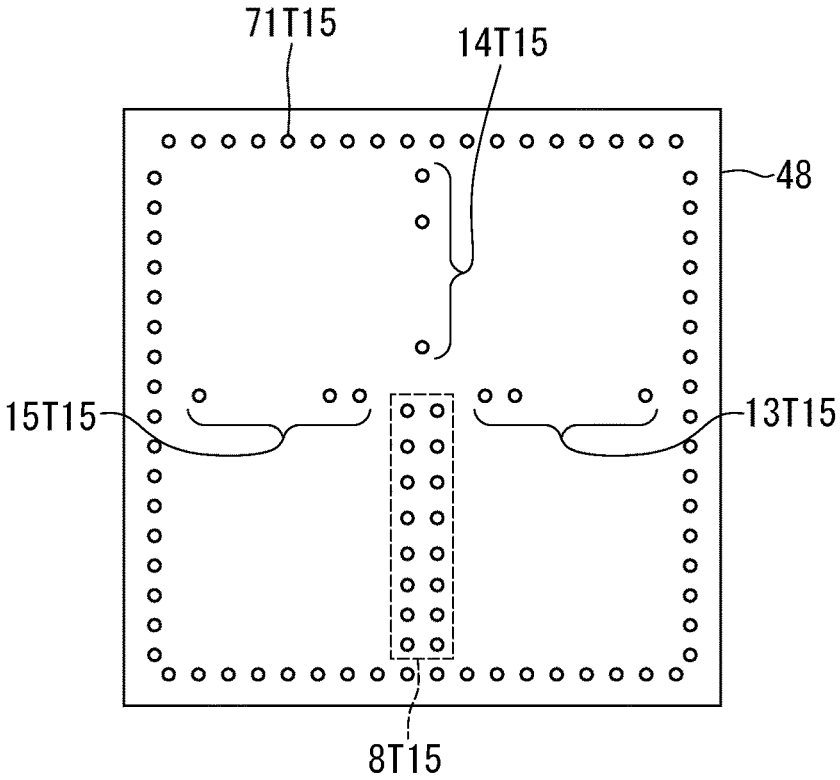
FIG. 26 is a plan view illustrating a patterned surface of an eighteenth dielectric layer of the peripheral dielectric portion shown in FIG. 18.

FIG. 26 illustrates a patterned surface of the eighteenth dielectric layer 48. In the dielectric layer 48, there are formed through holes 8T15, 13T15, 14T15, 15T15, and 71T15 constituting respective portions of the through hole lines 8T, 13T, 14T, 15T, and 71T. All the through holes in FIG. 26 except the through holes 8T15, 13T15, 14T15, and 15T15 are the through holes 71T15.

The through holes 8T14, 13T14, 14T14, 15T14, and 71T14 formed in the seventeenth dielectric layer 47 are connected to the through holes 8T15, 13T15, 14T15, 15T15, and 71T15, respectively.

Figure 27:
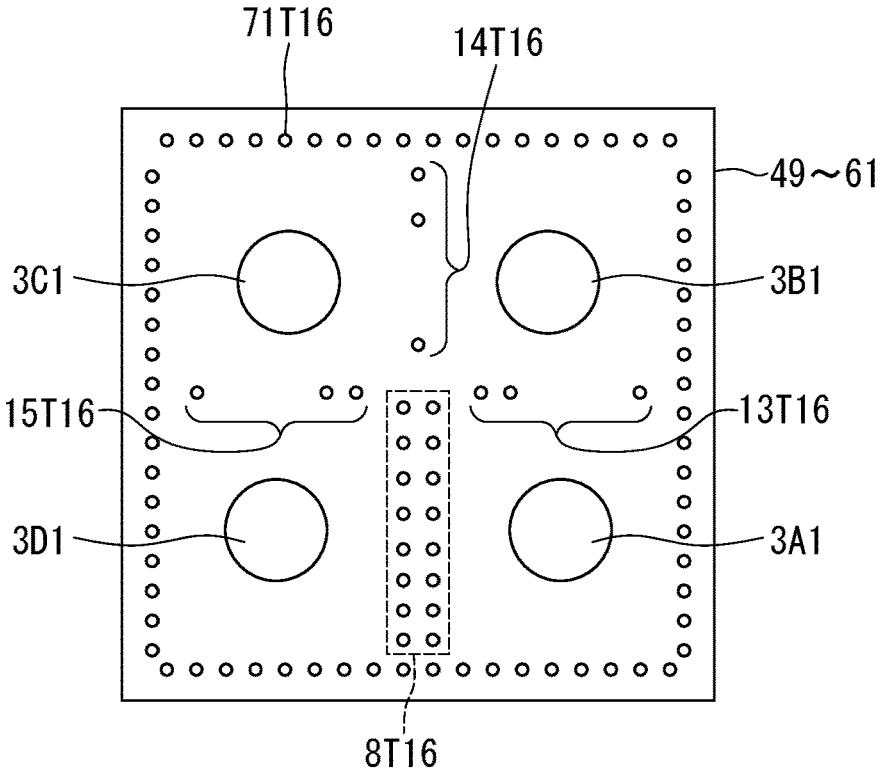
FIG. 27 is a plan view illustrating a patterned surface of each of a nineteenth to a thirty-first dielectric layer of the peripheral dielectric portion shown in FIG. 18.

FIG. 27 illustrates a patterned surface of each of the nineteenth to thirty-first dielectric layers 49 to 61. In each of the dielectric layers 49 to 61, there are formed through holes 8T16, 13T16, 14T16, 15T16, and 71T16 constituting respective portions of the through hole lines 8T, 13T, 14T, 15T, and 71T. All the through holes in FIG. 27 except the through holes 8T16, 13T16, 14T16, and 15T16 are the through holes 71T16.

The through holes 8T15, 13T15, 14T15, 15T15, and 71T15 shown in FIG. 26 are respectively connected to the through holes 8T16, 13T16, 14T16, 15T16, and 71T16 formed in the nineteenth dielectric layer 49. In the dielectric layers 49 to 61, every vertically adjacent through holes denoted by the same reference signs are connected to each other.

The individual elements 3A1, 3B1, 3C1, and 3D1 extend through the dielectric layers 49 to 61.

As shown in FIG. 13, the shield conductor layer 72 is formed on the patterned surface of the thirty-second dielectric layer 62. The through holes 8T16, 13T16, 14T16, 15T16, and 71T16 formed in the thirty-first dielectric layer 61 are connected to the shield conductor layer 72.

As in the first embodiment, the peripheral dielectric portion 4 is formed by stacking the dielectric layers 31 to 62 such that the patterned surface of the dielectric layer 31 shown in FIG. 6 constitutes the bottom surface 4*a* of the peripheral dielectric portion 4.

The individual elements 3A2 and 3D2 extend through the dielectric layers 37 to 47. The individual elements 3B2 and 3C2 extend through the dielectric layers 35 to 47. The individual elements 3A1, 3B1, 3C1 and 3D1 extend through the dielectric layers 49 to 61.

The conductor layer 361 shown in FIG. 24 is opposed to the bottom end face of the individual element 3A2 with the dielectric layer 36 interposed therebetween. The conductor layer 362 shown in FIG. 24 is opposed to the bottom end face of the individual element 3D2 with the dielectric layer 36 interposed therebetween.

Such a configuration is also possible that the individual elements 3A2 and 3D2 extend through the dielectric layer 36, with the bottom end faces of the individual elements 3A2 and 3D2 in contact with the conductor layers 361 and 362, respectively. An equivalent circuit of the dielectric filter 1 of such a configuration is as shown in FIG. 5.

The bottom end faces of the individual elements 3A1, 3B1, 3C1 and 3D1 are opposed to the top end faces of the individual elements 3A2, 3B2, 3C2 and 3D2, respectively, with the dielectric layer 48 interposed therebetween. The top end faces of the individual elements 3A1, 3B1, 3C1 and 3D1 are in contact with the shield conductor layer 72.

Next, first and second examples of methods for manufacturing the dielectric filter 1 according to the present embodiment will be described. Both of the first and second examples include a step of fabricating an unfired multilayer stack which is to be fired later into the structure 20, and a step of subjecting the unfired multilayer stack to firing to complete the structure 20. The first example and the second example are different in the content of the step of fabricating the unfired multilayer stack.

In the first example, the step of fabricating the unfired multilayer stack starts with fabricating a plurality of unfired ceramic sheets, which are to become the dielectric layers 31 to 62 later. Next, a plurality of unfired through holes are formed in ones of the ceramic sheets that correspond to ones of the dielectric layers that each have a plurality of through holes formed therein.

Further, two holes for accommodating respective portions of the individual elements 3B2 and 3C2 are formed in each of two of the ceramic sheets that are to become the dielectric layers 35 and 36. Further, four holes for accommodating respective portions of the individual elements 3A2, 3B2, 3C2, and 3D2 are formed in each of eleven of the ceramic sheets that are to become the dielectric layers 37 to 47. Further, four holes for accommodating respective portions of the individual elements 3A1, 3B1, 3C1, and 3D1 are formed in each of thirteen of the ceramic sheets that are to become the dielectric layers 49 to 61.

Then, the plurality of holes formed in each of those ceramic sheets to become the dielectric layers 35 to 47 and 49 to 61 are filled with a material that is to become the first dielectric when fired later. Further, one or more unfired conductor layers are formed on ones of the ceramic sheets that correspond to ones of the dielectric layers that each have one or more conductor layers formed thereon. The plurality of unfired ceramic sheets processed as above are then stacked together to complete the unfired multilayer stack.

In the second example, the step of fabricating the unfired multilayer stack starts with fabricating a plurality of unfired ceramic sheets, which are to become the dielectric layers 31 to 62 later. Next, a plurality of unfired through holes are formed in ones of the ceramic sheets that correspond to ones of the dielectric layers that each have a plurality of through holes formed therein. Further, one or more unfired conductor layers are formed on ones of the ceramic sheets that correspond to ones of the dielectric layers that each have one or more conductor layers formed thereon.

Next, eleven of the ceramic sheets that are to become the dielectric layers 37 to 47 are stacked together to form a first initial multilayer stack. Two holes for accommodating the individual elements 3A2 and 3D2 are then formed in the first initial multilayer stack. The two holes are then filled with a material that is to become the first dielectric when fired later.

Then, two of the ceramic sheets that are to become the dielectric layers 35 and 36 are stacked on the first initial multilayer stack to form a second initial multilayer stack. Two holes for accommodating the individual elements 3B2 and 3C2 are then formed in the second initial multilayer stack. The two holes are then filled with the material that is to become the first dielectric when fired later.

Next, thirteen of the ceramic sheets that are to become the dielectric layers 49 to 61 are stacked together to form a third initial multilayer stack. Four holes for accommodating the individual elements 3A1, 3B1, 3C1, and 3D1 are then formed in the third initial multilayer stack. The four holes are then filled with the material that is to become the first dielectric when fired later.

Next, four of the ceramic sheets that are to become the dielectric layers 31 to 34, the second initial multilayer stack, one of the ceramic sheets that is to become the dielectric layer 48, and one of the ceramic sheets that is to become the dielectric layer 62 are stacked together to complete the unfired multilayer stack.

In the present embodiment, each of the resonator bodies 3A to 3D includes a plurality of individual elements separated from each other. This makes it possible to reduce a variation in the resonant frequency of each of the dielectric resonators 2A to 2D resulting from a variation in the volume of each of the resonator bodies 3A to 3D, and to thereby reduce a variation in the passband of the dielectric filter 1, compared to when each of the resonator bodies 3A to 3D is constructed of a single block of dielectric.

The foregoing effect will be described in detail below with reference to the results of a second simulation. In the second simulation, the comparative example model used in the first simulation and a model of the dielectric resonator according to the second embodiment were compared in terms of variations in the resonant frequency of the dielectric resonators resulting from variations in the volume of the resonator bodies. In the second simulation also, variations were expressed by the ratio of a standard deviation to a design value. Hereinafter, the model of the dielectric resonator according to the second embodiment will be referred to as the second example model.

Figure 28:
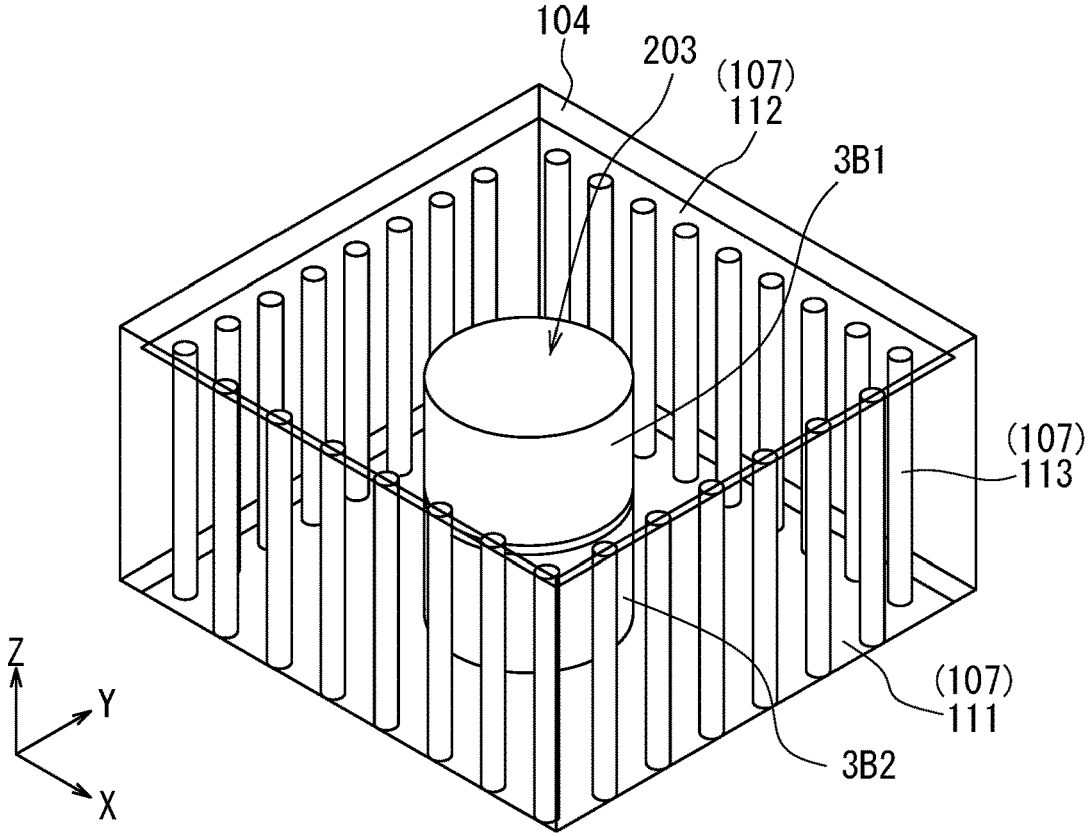
FIG. 28 is a perspective view of a model of a second example.

FIG. 28 is a perspective view of the second example model. The second example model has a resonator body 203 formed of the first dielectric, a peripheral dielectric portion 104, and a shield portion 107.

The resonator body 203 includes two individual elements 3B1 and 3B2. The resonator body 203 has the same configuration as the resonator body 3B of the present embodiment. The second example model corresponds to the dielectric resonator 2B of the present embodiment.

The peripheral dielectric portion 104 and the shield portion 107 of the second example model are the same in configuration as those of the comparative example model.

In the second simulation, the comparative example model and the second example model were designed to have approximately equal resonant frequencies.

In the second example model, the diameter of a cross section of each of the individual elements 3B1 and 3B2 perpendicular to the Z direction was 640 μm in design value. The resonant frequency of the second example model was 29616 MHz in design value.

In the second simulation, it was assumed for the second example model that the diameter of the cross section of each of the individual elements 3B1 and 3B2 had a variation of 10%. In such a case, the variation in the diameter of the cross section of each of the individual elements 3B1 and 3B2 results in a variation of 10.5% in the volume of the resonator body 203. Note that the volume of the resonator body 203 refers to the total of the volumes of the individual elements 3B1 and 3B2.

In the second simulation, a standard deviation σfn of the resonant frequency resulting from the variation in the diameter of the cross section of each of the individual elements 3B1 and 3B2 was determined for the second example model. The standard deviation σfn of the resonant frequency resulting from the variation in the diameter of the cross section of the individual element 3B1 was 598 MHz. The standard deviation σfn of the resonant frequency resulting from the variation in the diameter of the cross section of the individual element 3B2 was 579 MHz.

Next, in the second simulation, a standard deviation of the resonant frequency resulting from the variations in the diameters of the cross sections of the two individual elements 3B1 and 3B2 was determined for the second example model. From the additivity of variances, the standard deviation of the resonant frequency is given by the square root of the sum of the squares of the respective standard deviations σfn for the individual elements 3B1 and 3B2. The standard deviation of the resonant frequency was 832 MHz. As a result, the variation in the resonant frequency of the second example model was 2.8%. Thus, the variation in the resonant frequency of the second example model was smaller than that of the comparative example model, which was 4.2%.

From the results of the second simulation, it can be seen that the present embodiment enables reduction of a variation in the resonant frequency of each of the dielectric resonators 2A to 2D resulting from a variation in the volume of each of the resonator bodies 3A to 3D, compared to when each of the resonator bodies 3A to 3D is constructed of a single block of dielectric.

The configuration, operation and effects of the present embodiment are otherwise the same as those of the first embodiment.

Third Embodiment

Figure 29:
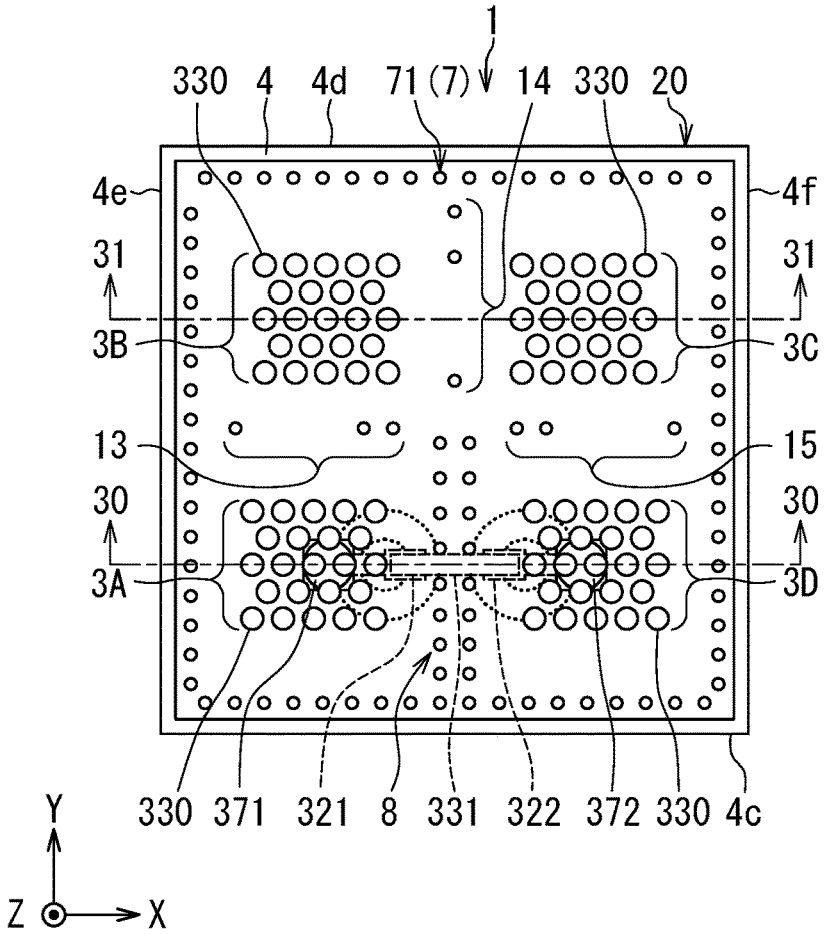
FIG. 29 is a plan view illustrating the interior of a dielectric filter according to a third embodiment of the invention.
Figure 30:
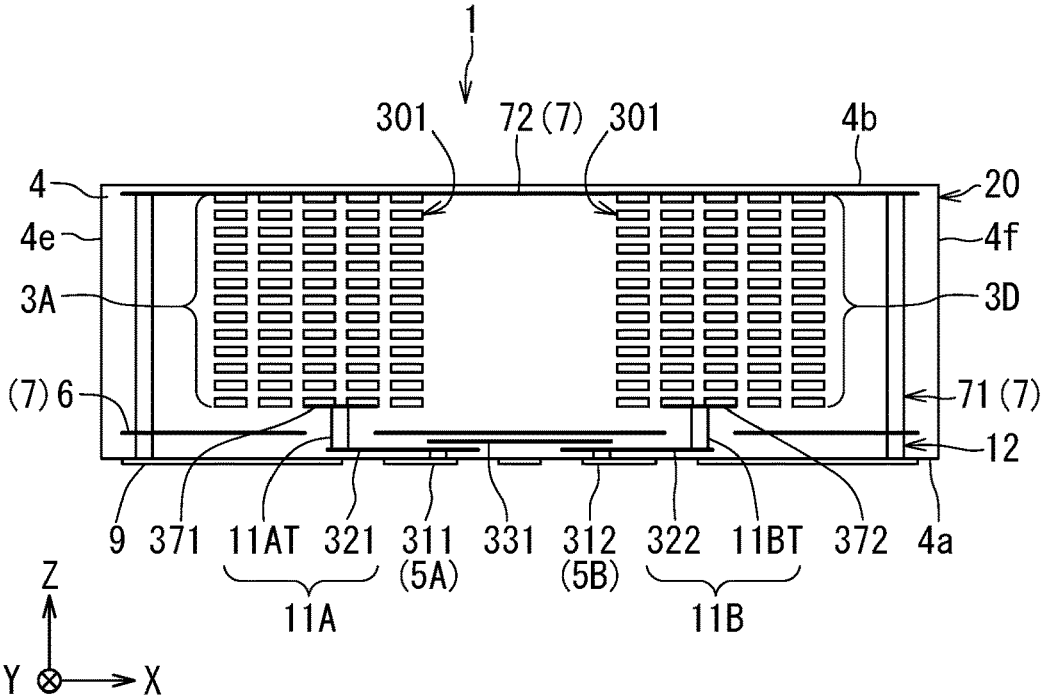
FIG. 30 is a cross-sectional view illustrating a cross section of the dielectric filter taken along line 30-30 of FIG. 29.
Figure 31:
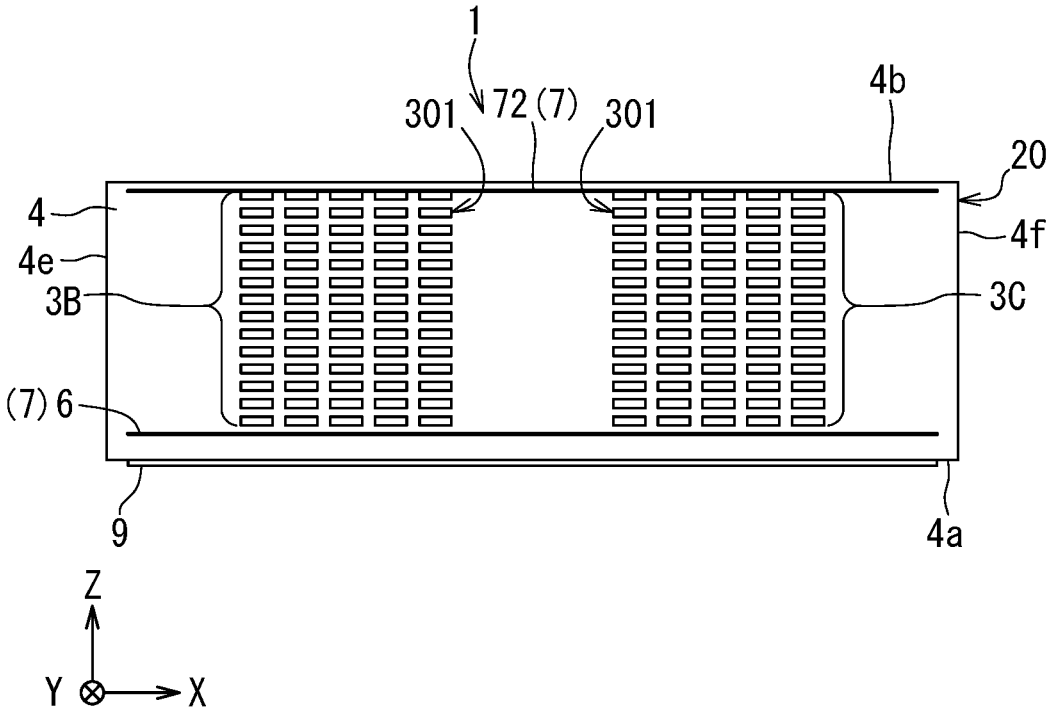
FIG. 31 is a cross-sectional view illustrating a cross section of the dielectric filter taken along line 31-31 of FIG. 29.

A third embodiment of the invention will now be described. FIG. 29 is a plan view illustrating the interior of a dielectric filter according to the third embodiment. FIG. 30 is a cross-sectional view illustrating a cross section of the dielectric filter taken along line 30-30 of FIG. 29. FIG. 31 is a cross-sectional view illustrating a cross section of the dielectric filter taken along line 31-31 of FIG. 29.

The dielectric filter 1 according to the present embodiment differs from the dielectric filter 1 according to the first embodiment in the following ways. In the dielectric filter 1 according to the present embodiment, each of the resonator bodies 3A to 3D has a different configuration from that in the first embodiment. In the present embodiment, each of the resonator bodies 3A to 3D includes a plurality of individual element groups aligned in the first direction, i.e., the Z direction. Each of the plurality of individual element groups includes a plurality of individual elements 330 separated from each other. In each of the plurality of individual element groups, adjacent two of the plurality of individual elements 330 are adjacent to each other in a direction orthogonal to the Z direction. The first direction or the Z direction is the direction of propagation of electromagnetic waves in each of the dielectric resonators 2A to 2D.

Two of the individual element groups adjacent in the Z direction may be offset with respect to each other as viewed in a direction parallel to the Z direction.

Each of the plurality of individual elements 330 included in one of adjacent two of the individual element groups may be in contact with either any one or none of the plurality of individual elements 330 included in the other of the adjacent two of the individual element groups.

In the present embodiment, specifically, each of the resonator bodies 3A, 3B, 3C, and 3D includes a first kind of individual element groups 301 and a second kind of individual element groups 302. The first kind of individual element groups 301 and the second kind of individual element groups 302 are alternately stacked in the Z direction to form each resonator body.

The first and second kinds of individual element groups 301 and 302 are offset with respect to each other as viewed in a direction parallel to the Z direction.

Figure 32:
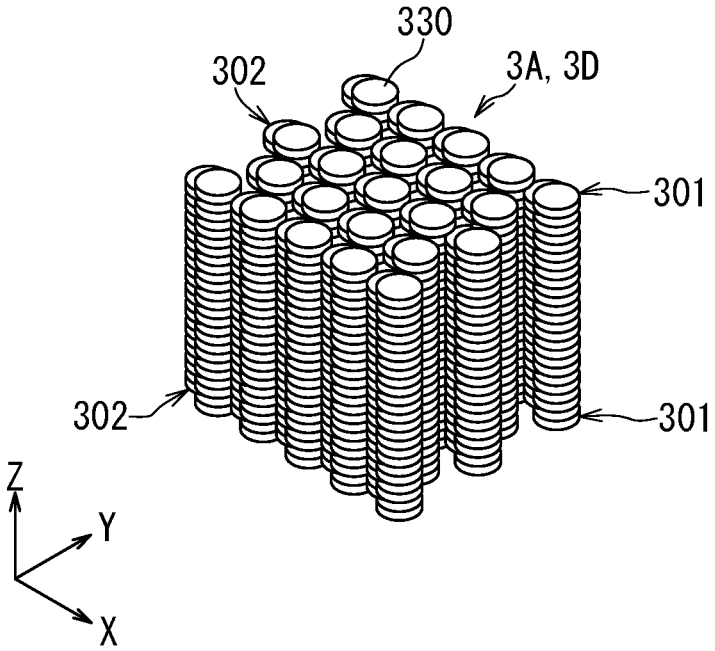
FIG. 32 is a perspective view of an input/output stage resonator body of the dielectric filter according to the third embodiment of the invention.

FIG. 32 is a perspective view illustrating the first and second input/output stage resonator bodies 3A and 3D. Each of the first and second input/output stage resonator bodies 3A and 3D includes thirteen first kind of individual element groups 301 and twelve second kind of individual element groups 302. Each of the first and second input/output stage resonator bodies 3A and 3D is formed by alternately stacking the first kind of individual element groups 301 and the second kind of individual element groups 302 in the Z direction such that the first kind of individual element groups 301 lie at opposite ends in the Z direction.

Figure 33:
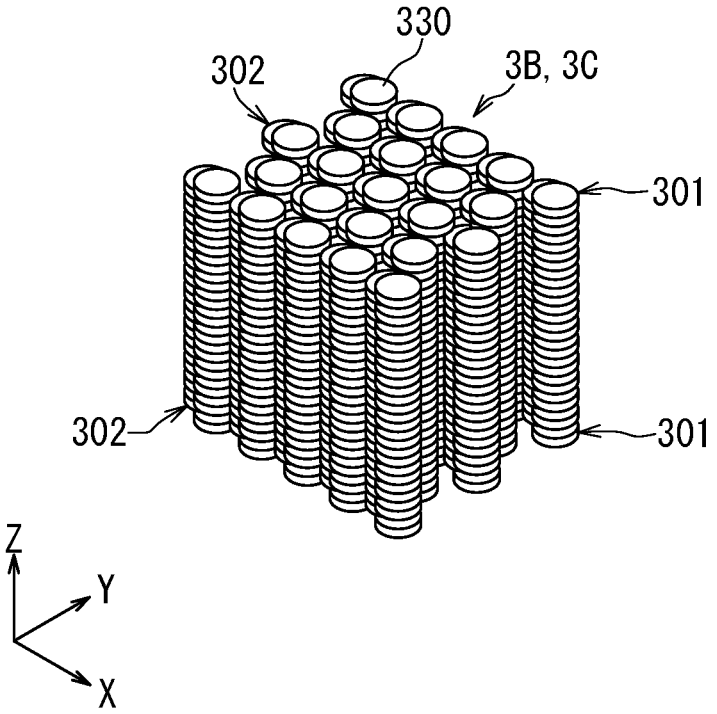
FIG. 33 is a perspective view of an intermediate resonator body of the dielectric filter according to the third embodiment of the invention.

FIG. 33 is a perspective view of the first and second intermediate resonator bodies 3B and 3C. Each of the first and second intermediate resonator bodies 3B and 3C includes fourteen first kind of individual element groups 301 and thirteen second kind of individual element groups 302. Each of the first and second intermediate resonator bodies 3B and 3C is formed by alternately stacking the first kind of individual element groups 301 and the second kind of individual element groups 302 in the Z direction such that the first kind of individual element groups 301 lie at opposite ends in the Z direction.

The plurality of individual elements 330 may each have a rod-like shape rotationally symmetrical with respect to an axis in the Z direction. Examples of such a shape include a cylindrical shape and a regular polygonal columnar shape. FIGS. 29, 32 and 33 show an example where the plurality of individual elements 330 each have a cylindrical shape.

In each of the resonator bodies 3A to 3D, the distance between adjacent two of the plurality of individual elements 330 included in a single individual element group may be less than or equal to a quarter of a wavelength corresponding to the resonant frequency of a corresponding one of the dielectric resonators 2A to 2D inside the peripheral dielectric portion 4.

In the present embodiment, specifically, each of the first and second kinds of individual element groups 301 and 302 includes twenty-three individual elements 330. The twenty-three individual elements 330 are aligned in three directions orthogonal to the Z direction. The three directions are, as viewed from above, the X direction, a direction rotated 60° clockwise from the X direction, and a direction rotated 60° counterclockwise from the X direction.

Here, one pitch is defined as the distance between the centers of adjacent two of the individual elements 330 in a cross section perpendicular to the Z direction. The magnitude of the offset between the first and second kinds of individual element groups 301 and 302 as viewed in a direction parallel to the Z direction may be less than one pitch.

In a cross section perpendicular to the Z direction, the centers of adjacent three of the individual elements 330 may be positioned such that they form a regular triangle when connected by lines. As viewed in a direction parallel to the Z direction, the second kind of individual element groups 302 may be offset with respect to the first kind of individual element groups 301 in a direction from one of the vertexes to the centroid of the foregoing regular triangle as much as the distance from the vertex to the centroid.

The peripheral dielectric portion 4 in the present embodiment includes a multilayer stack composed of a plurality of dielectric layers stacked together, as in the first embodiment.

Reference is now made to FIGS. 34 to 38 to describe an example of the plurality of dielectric layers constituting the peripheral dielectric portion 4 of the present embodiment and an example of the configurations of a plurality of conductor layers formed on the dielectric layers and a plurality of through holes formed in the dielectric layers. In this example, the peripheral dielectric portion 4 includes a first to a thirty-second dielectric layers 31 to 62 as in the first embodiment. In FIGS. 34 to 38, each small circle represents a through hole.

The configurations of the first to fourth dielectric layers 31 to 34 and the conductor layers and through holes formed thereon/therein are the same as those in the first embodiment, and as illustrated in FIGS. 6 to 9.

Figure 34:
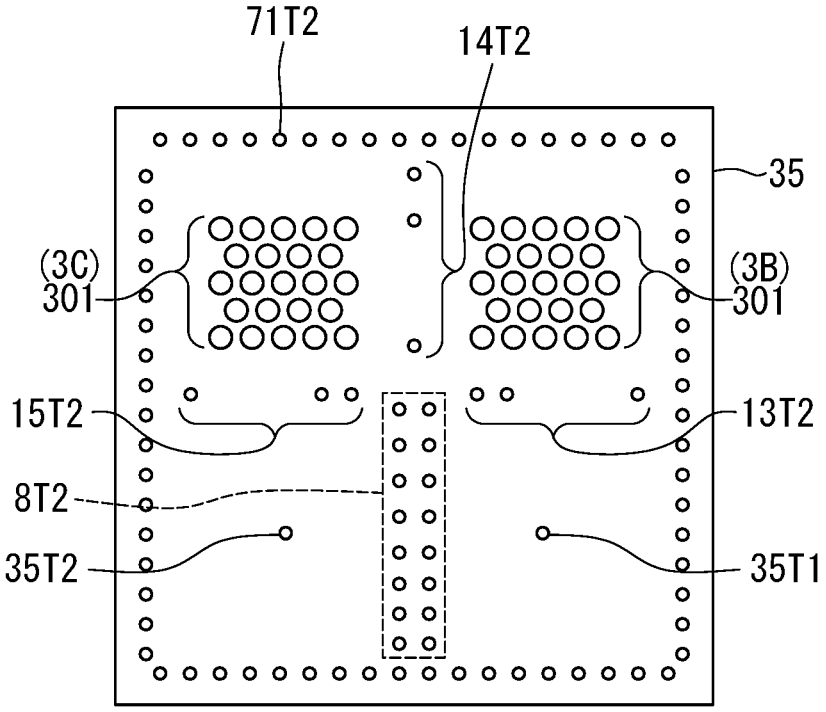
FIG. 34 is a plan view illustrating a patterned surface of a fifth dielectric layer of a peripheral dielectric portion shown in FIG. 29.

FIG. 34 illustrates a patterned surface of the fifth dielectric layer 35. Through holes 35T1 and 35T2 are formed in the dielectric layer 35. Further formed in the dielectric layer 35 are through holes 8T2, 13T2, 14T2, 15T2, and 71T2 constituting respective portions of the through hole lines 8T, 13T, 14T, 15T, and 71T. All the through holes in FIG. 34 except the through holes 35T1, 35T2, 8T2, 13T2, 14T2 and 15T2 are the through holes 71T2.

The through holes 34T1, 34T2, 8T1, 13T1, 14T1, 15T1, and 71T1 formed in the fourth dielectric layer 34 shown in FIG. 9 are connected to the through holes 35T1, 35T2, 8T2, 13T2, 14T2, 15T2, and 71T2, respectively.

The first kind of individual element groups 301 of the resonator bodies 3B and 3C are provided in the dielectric layer 35 to extend therethrough.

Figure 35:
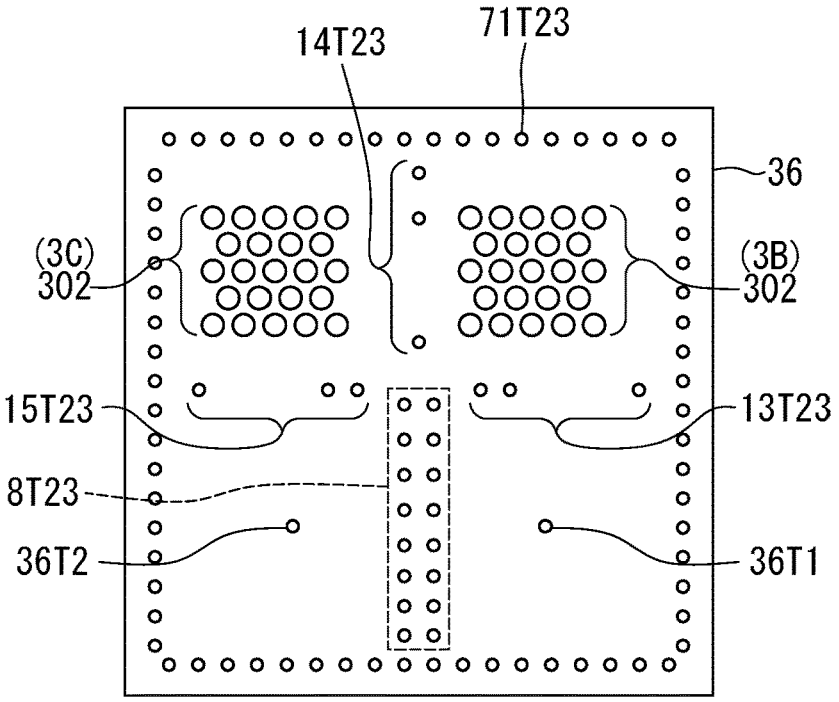
FIG. 35 is a plan view illustrating a patterned surface of a sixth dielectric layer of the peripheral dielectric portion shown in FIG. 29.

FIG. 35 illustrates a patterned surface of the sixth dielectric layer 36. Through holes 36T1 and 36T2 are formed in the dielectric layer 36. Further formed in the dielectric layer 36 are through holes 8T23, 13T23, 14T23, 15T23, and 71T23 constituting respective portions of the through hole lines 8T, 13T, 14T, 15T, and 71T. All the through holes in FIG. 35 except the through holes 36T1, 36T2, 8T23, 13T23, 14T23 and 15T23 are the through holes 71T23.

The through holes 35T1, 35T2, 8T2, 13T2, 14T2, 15T2, and 71T2 shown in FIG. 34 are connected to the through holes 36T1, 36T2, 8T23, 13T23, 14T23, 15T23, and 71T23, respectively.

The second kind of individual element groups 302 of the resonator bodies 3B and 3C are provided in the dielectric layer 36 to extend therethrough.

Figure 36:
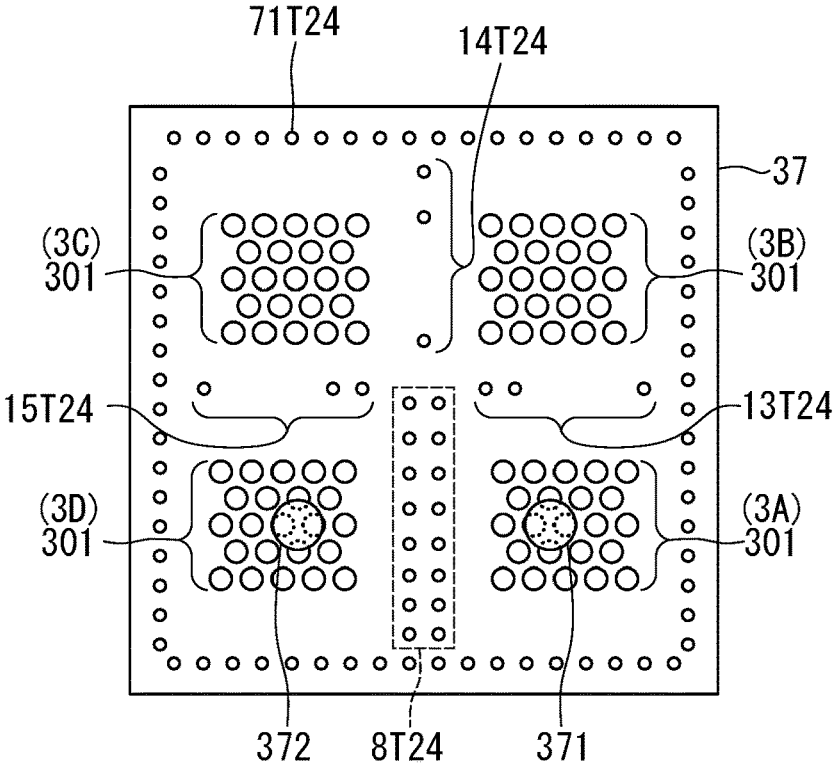
FIG. 36 is a plan view illustrating a patterned surface of a seventh dielectric layer of the peripheral dielectric portion shown in FIG. 29.

FIG. 36 illustrates a patterned surface of the seventh dielectric layer 37. Conductor layers 371 and 372 are formed on the patterned surface of the dielectric layer 37. The through holes 36T1 and 36T2 shown in FIG. 35 are connected to the conductor layers 371 and 372, respectively.

Further formed in the dielectric layer 37 are through holes 8T24, 13T24, 14T24, 15T24, and 71T24 constituting respective portions of the through hole lines 8T, 13T, 14T, 15T, and 71T. All the through holes in FIG. 36 except the through holes 8T24, 13T24, 14T24, and 15T24 are the through holes 71T24.

The through holes 8T23, 13T23, 14T23, 15T23, and 71T23 shown in FIG. 35 are connected to the through holes 8T24, 13T24, 14T24, 15T24, and 71T24, respectively.

The first kind of individual element groups 301 of the resonator bodies 3A to 3D are provided in the dielectric layer 37 to extend therethrough.

Figure 37:
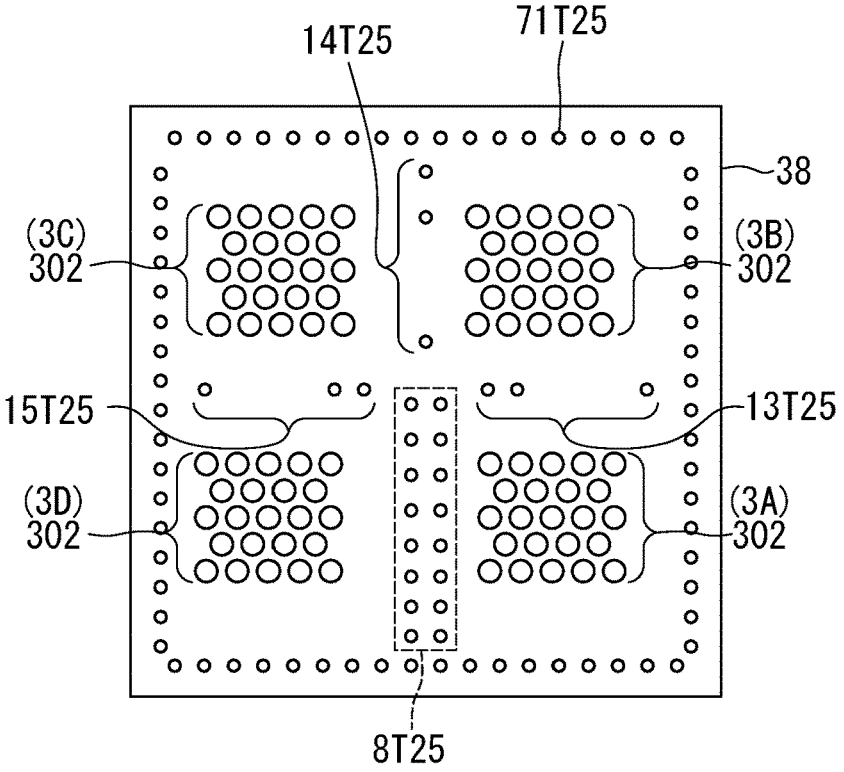
FIG. 37 is a plan view illustrating a patterned surface of an eighth dielectric layer of the peripheral dielectric portion shown in FIG. 29.

FIG. 37 illustrates a patterned surface of the eighth dielectric layer 38. In the dielectric layer 38, there are formed through holes 8T25, 13T25, 14T25, 15T25, and 71T25 constituting respective portions of the through hole lines 8T, 13T, 14T, 15T, and 71T. All the through holes in FIG. 37 except the through holes 8T25, 13T25, 14T25, and 15T25 are the through holes 71T25.

The through holes 8T24, 13T24, 14T24, 15T24, and 71T24 shown in FIG. 36 are connected to the through holes 8T25, 13T25, 14T25, 15T25, and 71T25, respectively.

The second kind of individual element groups 302 of the resonator bodies 3A to 3D are provided in the dielectric layer 38 to extend therethrough.

Figure 38:
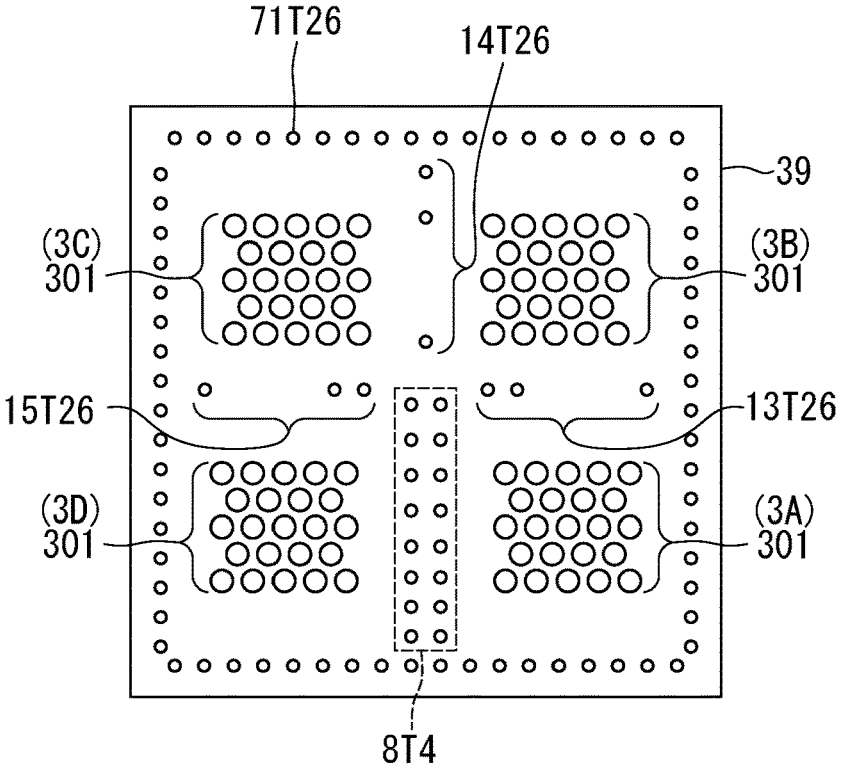
FIG. 38 is a plan view illustrating a patterned surface of a ninth dielectric layer of the peripheral dielectric portion shown in FIG. 29.

FIG. 38 illustrates a patterned surface of the ninth dielectric layer 39. In the dielectric layer 39, there are formed through holes 8T26, 13T26, 14T26, 15T26, and 71T26 constituting respective portions of the through hole lines 8T, 13T, 14T, 15T, and 71T. All the through holes in FIG. 38 except the through holes 8T26, 13T26, 14T26, and 15T26 are the through holes 71T26.

The through holes 8T25, 13T25, 14T25, 15T25, and 71T25 shown in FIG. 37 are connected to the through holes 8T26, 13T26, 14T26, 15T26, and 71T26, respectively.

The first kind of individual element groups 301 of the resonator bodies 3A to 3D are provided in the dielectric layer 39 to extend therethrough.

Like the dielectric layer 38, each of even-numbered dielectric layers among the tenth to thirtieth dielectric layers is provided with a plurality of through holes and the second kind of individual element groups 302 of the resonator bodies 3A to 3D.

Like the dielectric layer 39, each of odd-numbered dielectric layers among the eleventh to thirty-first dielectric layers is provided with a plurality of through holes and the first kind of individual element groups 301 of the resonator bodies 3A to 3D.

In the present embodiment, the through hole line 11AT shown in FIG. 30 is composed of the through holes 32T1, 33T1, 34T1, 35T1, and 36T1 connected in series. The through hole line 11BT shown in FIG. 30 is composed of the through holes 32T2, 33T2, 34T2, 35T2, and 36T2 connected in series.

The dielectric filter 1 according to the present embodiment can be manufactured by the first example of the manufacturing method for the dielectric filter 1 described in relation to the first embodiment, for example.

In the present embodiment, each of the resonator bodies 3A to 3D includes a larger number of individual elements than in the first and second embodiments. The present embodiment thus achieves a further reduction of a variation in the resonant frequency of each of the dielectric resonators 2A to 2D resulting from a variation in the volume of each of the resonator bodies 3A to 3D.

The configuration, operation and effects of the present embodiment are otherwise the same as those of the first embodiment.

The present invention is not limited to the foregoing embodiments, and various modifications may be made thereto. For example, the number and shape of the individual elements included in a single resonator body are not limited to those illustrated in the foregoing embodiments but can be freely chosen as far as the requirements of the appended claims are met.

Obviously, many modifications and variations of the present invention are possible in the light of the above teachings. Thus, it is to be understood that, within the scope of the appended claims and equivalents thereof, the invention may be practiced in other embodiments than the foregoing most preferable embodiments.

What is claimed is:

1. A dielectric resonator comprising:

a resonator body formed of a first dielectric having a first relative permittivity; and a peripheral dielectric portion lying around the resonator body, the peripheral dielectric portion being formed of a second dielectric having a second relative permittivity lower than the first relative permittivity, wherein the resonator body includes a plurality of individual elements separated from each other, and a distance between adjacent two of the plurality of individual elements is less than or equal to a quarter of a wavelength corresponding to a resonant frequency of the dielectric resonator inside the peripheral dielectric portion.

2. The dielectric resonator according to claim 1, further comprising a shield portion formed of a conductor, the shield portion lying around the resonator body such that at least part of the peripheral dielectric portion is interposed between the shield portion and the resonator body.

3. The dielectric resonator according to claim 1, wherein a resonance mode of the dielectric resonator is a TM mode.

4. The dielectric resonator according to claim 1, wherein all the plurality of individual elements have a rotationally symmetrical shape with respect to an axis in a same direction.

5. The dielectric resonator according to claim 1, wherein all the plurality of individual elements have a rod-like shape long in a first direction, and adjacent two of the plurality of individual elements are adjacent to each other in a direction orthogonal to the first direction.

6. The dielectric resonator according to claim 5, wherein the first direction is a direction of propagation of electromagnetic waves in the dielectric resonator.

7. The dielectric resonator according to claim 1, wherein the plurality of individual elements are aligned in a first direction.

8. The dielectric resonator according to claim 7, wherein the first direction is a direction of propagation of electromagnetic waves in the dielectric resonator.

9. The dielectric resonator according to claim 1, wherein the peripheral dielectric portion includes a multilayer stack composed of a plurality of dielectric layers stacked together.

10. The dielectric resonator according to claim 9, further comprising a shield portion formed of a conductor, wherein the shield portion lies around the resonator body such that at least part of the peripheral dielectric portion is interposed between the shield portion and the resonator body, the shield portion includes a first conductor layer and a second conductor layer lying at different positions in a direction in which the plurality of dielectric layers are stacked, and a plurality of through hole lines connecting the first and second conductor layers, and each of the plurality of through hole lines includes two or more through holes connected in series.

11. A dielectric resonator comprising:

a resonator body formed of a first dielectric having a first relative permittivity; and a peripheral dielectric portion lying around the resonator body, the peripheral dielectric portion being formed of a second dielectric having a second relative permittivity lower than the first relative permittivity, wherein the resonator body includes a plurality of individual element groups aligned in a first direction, each of the plurality of individual element groups including a plurality of individual elements separated from each another, and in each of the plurality of individual element groups, adjacent two of the plurality of individual elements are adjacent to each other in a direction orthogonal to the first direction.

12. The dielectric resonator according to claim 11, wherein the first direction is a direction of propagation of electromagnetic waves in the dielectric resonator.

13. The dielectric resonator according to claim 11, wherein two of the plurality of individual element groups adjacent in the first direction are offset with respect to each other as viewed in a direction parallel to the first direction.

14. A dielectric resonator comprising:

a resonator body formed of a first dielectric having a first relative permittivity; and a peripheral dielectric portion lying around the resonator body, the peripheral dielectric portion being formed of a second dielectric having a second relative permittivity lower than the first relative permittivity, wherein the resonator body includes a plurality of individual elements separated from each other, all the plurality of individual elements have a rotationally symmetrical shape with respect to an axis in a first direction, and the plurality of individual elements are aligned in the first direction.

15. A dielectric filter comprising:

a plurality of dielectric resonators;

a plurality of resonator bodies respectively corresponding to the plurality of dielectric resonators, each of the plurality of resonator bodies being formed of a first dielectric having a first relative permittivity; and a peripheral dielectric portion lying around the plurality of resonator bodies, the peripheral dielectric portion being formed of a second dielectric having a second relative permittivity lower than the first relative permittivity, wherein each of the plurality of resonator bodies includes a plurality of individual elements separated from each other, and a distance between adjacent two of the plurality of individual elements in each of the plurality of resonator bodies is less than or equal to a quarter of a wavelength corresponding to a resonant frequency of a corresponding one of the plurality of dielectric resonators inside the peripheral dielectric portion.

16. The dielectric filter according to claim 15, wherein a distance between adjacent two of the plurality of individual elements in each of the plurality of resonator bodies is smaller than a distance between adjacent two of the plurality of the resonator bodies.

17. The dielectric filter according to claim 15, further comprising a shield portion formed of a conductor, wherein the shield portion lies around the plurality of resonator bodies such that at least part of the peripheral dielectric portion is interposed between the shield portion and the plurality of resonator bodies, and each of the plurality of dielectric resonators is composed of a corresponding one of the plurality of resonator bodies, at least part of the peripheral dielectric portion, and the shield portion.

18. The dielectric filter according to claim 15, wherein a resonance mode of each of the plurality of dielectric resonators is a TM mode.

* * * * *